US012158326B1

(12) United States Patent
McLoughlin et al.

(10) Patent No.: US 12,158,326 B1
(45) **Date of Patent: *Dec. 3, 2024**

(54) ACTIVE SPIN CONTROL

(71) Applicant: Northrop Grumman Systems Corporation, Falls Church, VA (US)

(72) Inventors: Terence McLoughlin, Eden Prairie, MN (US); Michael Wilson, Lakeville, MN (US); Warren S. Jensen, Whitehall, MT (US)

(73) Assignee: Northrop Grumman Systems Corporation, Falls Church, VA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/531,158

(22) Filed: Dec. 6, 2023

Related U.S. Application Data

(63) Continuation of application No. 18/096,266, filed on Jan. 12, 2023, now abandoned, which is a (Continued)

(51) Int. Cl.
*F42B 10/54* (2006.01)
*F42B 10/26* (2006.01)
*F42B 10/64* (2006.01)

(52) U.S. Cl.
CPC ..... *F42B 10/54* (2013.01); *F42B 10/26* (2013.01); *F42B 10/64* (2013.01)

(58) Field of Classification Search
CPC ..... F42B 10/00–668; F42B 14/00–08
See application file for complete search history.

(56) References Cited

U.S. PATENT DOCUMENTS 2,340,781 A 2/1944 Wagner
2,513,157 A 6/1950 Ferris et al.
(Continued)

FOREIGN PATENT DOCUMENTS

CA 2441277 10/2002
EP 0675335 10/1995
(Continued)

OTHER PUBLICATIONS

Baig et al., "Architecture for Range, Doppler and Direction Finding Radar", J. Appl. Environ. Biol. Sci., vol. 4, No. 7S, 2014, pp. 193-198.

(Continued)

*Primary Examiner* — Matthew M Barker
(74) *Attorney, Agent, or Firm* — Christensen, Fonder, Dardi & Herbert PLLC

(57) ABSTRACT

Controlling an in-flight spin-rate of a spin-stabilized guided projectile is disclosed. In various embodiments, the projectile includes a despun control portion configured for despinning relative to a projectile chassis and for directional control of the projectile. In various embodiments, controlling the in-flight spin-rate includes determining a gyroscopic stability factor for the guided projectile using the in-flight spin rate and a forward velocity of the guided projectile, determining that the gyroscopic stability factor exceeds a stability threshold, and spin-braking the guided projectile, in response to determining that the gyroscopic stability factor exceeds a threshold value, by braking rotation of the despun control portion by which the gyroscopic stability factor of the guided projectile is reduced to a second gyroscopic stability factor.

18 Claims, 9 Drawing Sheets

Related U.S. Application Data continuation of application No. 15/998,144, filed on Jul. 9, 2018, now Pat. No. 11,555,679.

(60) Provisional application No. 62/529,581, filed on Jul. 7, 2017.

(56) References Cited

U.S. PATENT DOCUMENTS

| | | | |
|---|---|---|---|
| 2,687,482 | A | 8/1954 | Harmon et al. |
| 2,996,008 | A | 8/1961 | Allen et al. |
| 3,000,307 | A | 9/1961 | Trotter, Jr. |
| 3,111,080 | A | 11/1963 | French et al. |
| 3,111,088 | A | 11/1963 | Fisk |
| 3,233,950 | A | 2/1966 | Baermann |
| 3,598,022 | A | 8/1971 | Maier |
| 3,614,181 | A | 10/1971 | Meeks |
| 3,747,529 | A | 7/1973 | Plattner |
| 3,913,870 | A | 10/1975 | Bolick |
| 3,939,773 | A | 2/1976 | Jenkins et al. |
| 3,943,520 | A | 3/1976 | Apstein et al. |
| 4,044,682 | A | 8/1977 | Karayannis |
| 4,088,076 | A | 5/1978 | Karayannis |
| 4,176,814 | A | 12/1979 | Albrektsson et al. |
| 4,202,515 | A | 5/1980 | Maxwell, Jr. |
| 4,207,841 | A | 6/1980 | Bloomer |
| 4,267,562 | A | 5/1981 | Raimondi |
| 4,347,996 | A | 9/1982 | Grosso |
| 4,373,688 | A | 2/1983 | Topliffe |
| 4,379,598 | A | 4/1983 | Goldowsky |
| 4,431,150 | A | 2/1984 | Epperson, Jr. |
| 4,438,893 | A | 3/1984 | Sands et al. |
| 4,512,537 | A | 4/1985 | Sebestyen et al. |
| 4,525,514 | A | 6/1985 | Yachigo et al. |
| 4,528,911 | A | 7/1985 | DePhillipo et al. |
| 4,537,371 | A | 8/1985 | Lawhorn et al. |
| 4,547,837 | A | 10/1985 | Bennett |
| 4,565,340 | A | 1/1986 | Bains |
| 4,568,039 | A | 2/1986 | Smith et al. |
| 4,664,339 | A | 5/1987 | Crossfield |
| 4,667,899 | A | 5/1987 | Wedertz |
| 4,815,682 | A | 3/1989 | Feldmann et al. |
| 4,860,969 | A | 8/1989 | Muller et al. |
| 4,898,342 | A | 2/1990 | Kranz et al. |
| 4,899,956 | A | 2/1990 | King et al. |
| 4,934,273 | A | 6/1990 | Endriz |
| 4,964,593 | A | 10/1990 | Kranz |
| 5,043,615 | A | 8/1991 | Oshima |
| 5,101,728 | A | 4/1992 | Frisk |
| 5,125,344 | A | 6/1992 | Kline et al. |
| 5,126,610 | A | 6/1992 | Fremerey |
| 5,139,216 | A | 8/1992 | Larkin |
| 5,271,328 | A | 12/1993 | Boulais et al. |
| 5,321,329 | A | 6/1994 | Hovorka |
| 5,327,140 | A | 7/1994 | Buckreub |
| 5,381,445 | A | 1/1995 | Hershey et al. |
| 5,425,514 | A | 6/1995 | Grosso |
| 5,452,864 | A | 9/1995 | Alford et al. |
| 5,489,909 | A | 2/1996 | Dittmann et al. |
| 5,495,221 | A | 2/1996 | Post |
| 5,506,459 | A | 4/1996 | Ritts |
| 5,529,262 | A | 6/1996 | Horwath |
| 5,619,083 | A | 4/1997 | Dunfield et al. |
| 5,669,581 | A | 9/1997 | Ringer |
| 5,696,347 | A | 12/1997 | Sebeny, Jr. et al. |
| 5,725,179 | A | 3/1998 | Gilman et al. |
| 5,734,389 | A | 3/1998 | Bruce et al. |
| 5,747,907 | A | 5/1998 | Miller |
| 5,775,636 | A | 7/1998 | Vig et al. |
| 5,780,766 | A | 7/1998 | Schröppel |
| 5,788,178 | A | 8/1998 | Barrett, Jr. |
| 5,894,181 | A | 4/1999 | Imlach |
| 5,917,442 | A | 6/1999 | Manoogian |
| 5,932,836 | A | 8/1999 | White |
| 5,971,875 | A | 10/1999 | Hill |
| 5,982,319 | A | 11/1999 | Borden et al. |
| 5,986,373 | A | 11/1999 | Stucker |
| 6,020,854 | A | 2/2000 | Jagnow et al. |
| 6,052,647 | A | 4/2000 | Parkinson et al. |
| 6,126,109 | A | 10/2000 | Barson et al. |
| 6,135,387 | A | 10/2000 | Seidel et al. |
| 6,163,021 | A | 12/2000 | Mickelson |
| 6,186,443 | B1 | 2/2001 | Shaffer |
| 6,204,801 | B1 | 3/2001 | Sharka et al. |
| 6,208,936 | B1 | 3/2001 | Minor et al. |
| 6,227,820 | B1 | 5/2001 | Jarvik |
| 6,234,082 | B1 | 5/2001 | Cros et al. |
| 6,314,886 | B1 | 11/2001 | Kuhnle et al. |
| 6,345,785 | B1 | 2/2002 | Harkins et al. |
| 6,352,218 | B1 | 3/2002 | Holmqvist et al. |
| 6,389,974 | B1 | 5/2002 | Foster |
| 6,390,642 | B1 | 5/2002 | Simonton |
| 6,398,155 | B1 | 6/2002 | Hepner et al. |
| 6,422,507 | B1 | 7/2002 | Lipeles |
| D461,159 | S | 8/2002 | Miralles et al. |
| 6,493,651 | B2 | 12/2002 | Harkins et al. |
| 6,502,786 | B2 | 1/2003 | Rupert et al. |
| 6,588,700 | B2 | 7/2003 | Moore et al. |
| 6,595,041 | B2 | 7/2003 | Hansen |
| 6,629,669 | B2 | 10/2003 | Jensen |
| 6,653,972 | B1 | 11/2003 | Krikorian et al. |
| 6,666,402 | B2 | 12/2003 | Rupert et al. |
| 6,693,592 | B2 | 2/2004 | Dowdle et al. |
| 6,727,843 | B1 | 4/2004 | Hansen |
| 6,796,525 | B2 | 9/2004 | Johnsson et al. |
| 6,806,605 | B1 | 10/2004 | Gabrys |
| 6,834,591 | B2 | 12/2004 | Rawcliffe et al. |
| 6,842,674 | B2 | 1/2005 | Solomon |
| 6,869,044 | B2 | 3/2005 | Geswender |
| 6,882,314 | B2 | 4/2005 | Zimmerman et al. |
| 6,889,934 | B1 | 5/2005 | Thomas et al. |
| 6,923,404 | B1 | 8/2005 | Liu et al. |
| 6,970,128 | B1 | 11/2005 | Dwelly et al. |
| 6,981,672 | B2 | 1/2006 | Clancy et al. |
| 7,015,855 | B1 | 3/2006 | Medl et al. |
| 7,020,501 | B1 | 3/2006 | Elliott et al. |
| 7,098,841 | B2 | 8/2006 | Hager et al. |
| 7,174,835 | B1 | 2/2007 | Knapp |
| 7,226,016 | B2 | 6/2007 | Johnsson et al. |
| 7,267,298 | B2 | 9/2007 | Leininger |
| 7,305,467 | B2 | 12/2007 | Kaiser et al. |
| 7,338,009 | B1 | 3/2008 | Bobinchak et al. |
| 7,341,221 | B1 | 3/2008 | Wilson |
| 7,354,017 | B2 | 4/2008 | Morris et al. |
| 7,412,930 | B2 | 8/2008 | Smith et al. |
| 7,422,175 | B1 | 9/2008 | Bobinchak et al. |
| 7,431,237 | B1 | 10/2008 | Mock et al. |
| 7,475,846 | B2 | 1/2009 | Schroeder |
| 7,500,636 | B2 | 3/2009 | Bredy |
| 7,548,202 | B1 | 6/2009 | Jennings |
| 7,566,027 | B1 | 7/2009 | Johnson et al. |
| 7,584,922 | B2 | 9/2009 | Bär et al. |
| 7,626,544 | B2 | 12/2009 | Smith et al. |
| 7,631,833 | B1 | 12/2009 | Ghaleb et al. |
| 7,675,012 | B1 | 3/2010 | Bobinchak et al. |
| 7,681,504 | B2 | 3/2010 | Machina et al. |
| 7,701,380 | B2 | 4/2010 | Altes |
| 7,781,709 | B1 | 8/2010 | Jones et al. |
| 7,791,007 | B2 | 9/2010 | Harnoy |
| 7,834,301 | B2 | 11/2010 | Clingman |
| 7,849,797 | B2 | 12/2010 | Geswender et al. |
| 7,849,800 | B2 | 12/2010 | Hinsdale et al. |
| 7,900,619 | B1 | 3/2011 | Palmer et al. |
| 7,947,936 | B1 | 5/2011 | Bobinchak et al. |
| 7,963,442 | B2 | 6/2011 | Jenkins et al. |
| 7,989,742 | B2 | 8/2011 | Bredy |
| 7,999,212 | B1 | 8/2011 | Thiesen et al. |
| 8,063,347 | B1 | 11/2011 | Urbano et al. |
| 8,076,623 | B2 | 12/2011 | Dryer |
| 8,113,118 | B2 | 2/2012 | Schmidt et al. |
| 8,125,198 | B2 | 2/2012 | Steinbrecher |
| 8,183,746 | B2 | 5/2012 | Rastegar |
| 8,229,163 | B2 | 7/2012 | Coleman et al. |
| 8,258,999 | B2 | 9/2012 | Rastegar et al. |
| 8,288,698 | B2 | 10/2012 | Seidensticker |

(56) References Cited

U.S. PATENT DOCUMENTS

| | | | |
|---|---|---|---|
| 8,288,699 | B2 | 10/2012 | Romero et al. |
| 8,319,162 | B2 | 11/2012 | Mccool |
| 8,319,163 | B2 | 11/2012 | Flood et al. |
| 8,319,164 | B2 | 11/2012 | Martinez |
| 8,324,542 | B2 | 12/2012 | Frey, Jr. |
| 8,344,303 | B2 | 1/2013 | Elgersma et al. |
| 8,410,412 | B2 | 4/2013 | Geswender et al. |
| 8,426,788 | B2 | 4/2013 | Geswender |
| 8,471,186 | B2 | 6/2013 | Wallis |
| 8,471,758 | B2 | 6/2013 | Samuel et al. |
| 8,487,226 | B2 | 7/2013 | Biswell |
| 8,508,404 | B1 | 8/2013 | Wilmhoff |
| 8,519,313 | B2 | 8/2013 | Geswender et al. |
| 8,552,349 | B1 | 10/2013 | Alexander |
| 8,552,351 | B2 | 10/2013 | Geswender et al. |
| 8,558,151 | B2 | 10/2013 | Seidensticker |
| 8,669,505 | B2 | 3/2014 | Guibout et al. |
| 8,674,277 | B2 | 3/2014 | Axford et al. |
| 8,698,059 | B2 | 4/2014 | Nikkel et al. |
| 8,701,558 | B2 | 4/2014 | Rastegar et al. |
| 8,716,639 | B2 | 5/2014 | Mallon |
| 8,748,787 | B2 | 6/2014 | Weiss et al. |
| 8,757,064 | B2 | 6/2014 | Jennings et al. |
| 8,812,654 | B2 | 8/2014 | Gelvin et al. |
| 8,816,260 | B2 | 8/2014 | Hindman et al. |
| 8,832,244 | B2 | 9/2014 | Gelvin et al. |
| 8,836,503 | B2 | 9/2014 | Gelvin et al. |
| 8,916,810 | B2 | 12/2014 | Geswender et al. |
| 8,950,335 | B2 | 2/2015 | Strömberg et al. |
| 8,993,948 | B2 | 3/2015 | Geswender et al. |
| D729,896 | S | 5/2015 | Martinez |
| 9,031,725 | B1 | 5/2015 | DiEsposti |
| 9,040,885 | B2 | 5/2015 | Morris et al. |
| 9,048,701 | B2 | 6/2015 | Lang |
| 9,052,202 | B2 | 6/2015 | Riley |
| 9,070,236 | B1 | 6/2015 | DiEsposti |
| 9,071,171 | B2 | 6/2015 | Rastegar et al. |
| 9,086,258 | B1 | 7/2015 | Vasudevan et al. |
| 9,108,713 | B2 | 8/2015 | Tao et al. |
| 9,187,184 | B2 | 11/2015 | Miralles et al. |
| 9,194,675 | B1 | 11/2015 | Manole et al. |
| 9,211,947 | B2 | 12/2015 | Miralles |
| 9,303,964 | B2 | 4/2016 | Wurzel et al. |
| 9,347,753 | B1 | 5/2016 | Horch et al. |
| 9,360,286 | B2 | 6/2016 | Pettersson et al. |
| 9,371,856 | B2 | 6/2016 | Kundel |
| 9,557,405 | B2 | 1/2017 | Takahashi et al. |
| 9,587,923 | B2 | 3/2017 | Wurzel et al. |
| 9,644,929 | B1 | 5/2017 | Bradbury et al. |
| 9,683,814 | B2 | 6/2017 | Dryer |
| 9,709,372 | B2 | 7/2017 | Edwards |
| 9,939,238 | B1 | 4/2018 | Sowle et al. |
| 10,054,404 | B2 | 8/2018 | Balk et al. |
| 10,203,188 | B1 | 2/2019 | Sowle et al. |
| 10,288,397 | B2 | 5/2019 | Rastegar et al. |
| 11,056,962 | B2 | 7/2021 | Kao |
| 2001/0030260 | A1 | 10/2001 | Niemeyer et al. |
| 2003/0076260 | A1 | 4/2003 | Ryken et al. |
| 2004/0046467 | A1 | 3/2004 | Huang et al. |
| 2004/0068415 | A1 | 4/2004 | Solomon |
| 2004/0099173 | A1 | 5/2004 | Rector et al. |
| 2004/0134337 | A1 | 7/2004 | Solomon |
| 2006/0061949 | A1 | 3/2006 | Chen et al. |
| 2008/0012751 | A1 | 1/2008 | Owens et al. |
| 2008/0061188 | A1 | 3/2008 | Morris et al. |
| 2008/0093498 | A1 | 4/2008 | Leal et al. |
| 2008/0223977 | A1 | 9/2008 | Dryer |
| 2008/0237391 | A1 | 10/2008 | Mock et al. |
| 2010/0199873 | A1 | 8/2010 | Rastegar |
| 2010/0213307 | A1 | 8/2010 | Hinsdale et al. |
| 2010/0237185 | A1 | 9/2010 | Dryer |
| 2011/0032361 | A1 | 2/2011 | Tamir |
| 2011/0094372 | A1 | 4/2011 | Carlson |
| 2012/0068000 | A1 | 3/2012 | Goldner et al. |
| 2012/0211593 | A1 | 8/2012 | Morris et al. |
| 2013/0126612 | A1 | 5/2013 | Durkee |
| 2013/0126667 | A1 | 5/2013 | Weiss et al. |
| 2013/0126668 | A1 | 5/2013 | Chessel et al. |
| 2015/0203201 | A1 | 7/2015 | Tao et al. |
| 2015/0330755 | A1 | 11/2015 | Citro et al. |
| 2016/0185445 | A1 | 6/2016 | Miralles et al. |
| 2016/0252333 | A1 | 9/2016 | Carlqvist et al. |
| 2016/0347476 | A1 | 12/2016 | Andryukov |
| 2017/0021945 | A1 | 1/2017 | Fisher et al. |
| 2017/0023057 | A1 | 1/2017 | Li et al. |
| 2017/0191809 | A1 | 7/2017 | Harris et al. |
| 2017/0299355 | A1 | 10/2017 | Trouillot et al. |
| 2018/0245895 | A1 | 8/2018 | Malul et al. |
| 2019/0041175 | A1 | 2/2019 | Fellows et al. |
| 2019/0041527 | A1 | 2/2019 | Gutafson |
| 2019/0302276 | A1 | 10/2019 | Sandford |
| 2020/0064112 | A1 | 2/2020 | Rami |
| 2020/0292287 | A1 | 9/2020 | Thoren et al. |

FOREIGN PATENT DOCUMENTS

| | | |
|---|---|---|
| EP | 2165152 | 8/2014 |
| GB | 2547425 | 8/2017 |
| WO | WO2007058573 | 5/2007 |

OTHER PUBLICATIONS

Bekmezci et al, "Flying Ad-Hoc Networks (FANETs): A Survey", posted on the Internet at elsevier.com/locate.adhoc; Jan. 8, 2013, published by Elsevier, Amsterdam, The Netherlands; 17 pages.

Costanzo et al., "High Resolution Software Defined Radar System for Target Detection", Journal of Electrical and Computer Engineering, vol. 2013, Article ID 573217, 2013, 8 pages.

Kwag et al., "Modern Software Defined Radar (SDR) Technology and Its Trends", Journal of Electromagnetic Engineering and Science, vol. 14, No. 4, Dec. 2014, pp. 321-328.

Zhang, B. et al. Mechanical Construction and Analysis of an Axial Flux Segmented Armature Torus Machine, International Conference on Electrical Machines, Sep. 2-5, 2014, pp. 1293-1299.

Zou, T. et al., "Analysis of a Dual-Rotor, Toroidal-Winding, Axial-Flux Vernier Permanent Magnet Machine", Institute of Electrical and Electronics Engineers, May/Jun. 2017, vol. 53, No. 3, pp. 1920-1930.

ACTIVE SPIN CONTROL

RELATED APPLICATIONS

The present application is a continuation of U.S. patent application Ser. No. 18/096,266, filed Jan. 12, 2023, which is a continuation of U.S. patent application Ser. No. 15/998,144, filed Jul. 9, 2018, issued as U.S. Pat. No. 11,555,679 on Jan. 17, 2023, which claims the benefit of U.S. Provisional Patent Application No. 62/529,581, filed Jul. 7, 2017, the disclosure of which are incorporated by reference herein in their entireties.

TECHNICAL FIELD

The present disclosure relates to guided projectiles, and more specifically, to spin-stabilized guided projectiles.

BACKGROUND

In various instances, non-boosted barrel-fired projectiles, such as bullets, shells, or other projectiles, are spin-stabilized to improve their accuracy via improved in-flight projectile stability. Generally, these projectiles are fired from a rifled barrel where rifled grooves grip the projectile and force it to spin at a high rate about a central projectile axis as it is pushed down the bore of the barrel by propellant gasses. This process imparts a spin to the projectile as it passes through the bore and, as such, the projectile is stabilized for flight.

In order to be considered stable, a projectile will generally possess gyroscopic stability. Gyroscopic stability generally acts to resist torqueing forces on the projectile to keep the nose of the projectile generally pointed in the forward firing direction during flight. In addition, different projectiles will require different spin rates to perform optimally. For example, among projectiles of the same caliber, longer projectiles will need a higher spin rate to stabilize than compared with shorter projectiles.

Projectile stability can be quantified by a gyroscopic stability factor (SG). Typically, a projectile that is fired with inadequate spin will have an SG less than 1.0 and will tumble in flight. However, if the projectile has a spin rate high enough to achieve an SG of 1.0 or higher, the projectile will fly generally pointed forward with improved accuracy and reduced drag compared to a non-spinning projectile.

Generally, a projectile will need a spin rate that is sufficient high enough to stabilize the projectile based on properties of the projectile, size, forward velocity, shape and other factors. For example, certain long range bullets will be longer and therefore possess special (e.g. higher) twist rate requirements.

Spin stabilized guided projectiles fired from rifled barrels typically have a main body portion and a flight control portion rotatable with respect to the main body. The rifling in the barrel rotates the projectile in a first direction by way of engagement with the main body portion or sabots containing the projectile. Upon firing, the main body portion is spun in a first rotational direction at a spin rate based on rifling and muzzle velocity. In some cases, the spin rate may exceed 10 kHz. The flight control portion of the projectile has aerodynamic surfaces, such as fins, to despin the flight control portion using oncoming airflow after the projectile is fired. The differential in spinning between the flight control portion and the main body portion may provide power for operating systems in the cartridge. In some instances, the spin rate of the flight control portion may be braked to 0 Hz, with respect to earth, by a braking system, and have an aerodynamic surface that may be appropriately positioned, that is, positioned in a desired rotational area, for changing the direction of the projectile.

Further improvements are always welcome for enhancing accuracy, allowing miniaturization, increasing range, providing cost savings and improved reliability of guided ammunition.

SUMMARY

One or more embodiments of the disclosure are directed to methods, systems, and apparatus for improving the performance of a control mechanism for a spin-stabilized guided projectile.

In one or more embodiments, the spin-stabilized guided projectile includes a control mechanism in the form of a despun control mechanism used to provide a maneuvering force on the projectile for selectively altering or otherwise controlling its trajectory while in flight. For example, in various embodiments, the control mechanism provides a force and corresponding moment on the projectile to control the angle of attack for the projectile. By controlling the angle of attack of the projectile while in-flight, the control mechanism can provide a corresponding lift force on the projectile that can alter its trajectory to "guide" or "steer" the projectile in various directions.

As such, in one or more embodiments the control mechanism is configured to selectively alter the trajectory of the projectile to compensate for various environmental factors, such as wind, that alter the flight path of the projectile from its originally intended path. In addition, in some embodiments, the control mechanism is used to selectively alter the trajectory of the guided projectile to compensate for an aiming error or to guide the projectile to a moving target.

As described above, the guided projectile is spin stabilized, meaning that the projectile is fired from a rifled barrel and is gyroscopically stabilized for flight by being spun around its longitudinal (forward to rearward) central axis. For example, the angular momentum resulting from the rotating motion of the projectile body acts to stabilize the projectile by resisting destabilizing torque to the projectile in-flight.

Gyroscopic stability can be quantified by a gyroscopic stability factor (SG). Described further below, SG is a unitless quantification of gyroscopic stability that can be calculated in various different ways, for example based on the type of projectile used or based on other factors. However, SG is typically based at least in part on the square of a ratio of the spin-rate of the projectile to the forward velocity of the projectile. As such, in various instances, the higher the spin-rate of the projectile, as compared to its velocity, the greater the SG. Conversely, the higher the velocity of the projectile, as compared to its spin-rate, the lesser the SG.

Generally, a projectile with an SG of at least 1.0 or higher is considered to be gyroscopically stabilized. However, the higher the SG the greater the gyroscopic stability. For example, a projectile with a GS of 1.0 or slightly above can be considered to be marginally stabilized as it will generally fly without tumbling but will fly with some amount of pitching and yawing as compared to projectiles having a SG of at least 1.3 or in some instances at least 1.5. Bullets with marginal stability can fly with relatively good accuracy and precision, however, the increased drag from pitching and yawing will reduce the effective ballistic coefficient for the projectile. This is particularly important for accurately hitting targets at medium or long range as projectiles with improved ballistic coefficient will better maintain velocity down-range.

As such, in various embodiments, spin stabilized guided projectiles will generally be fired with a spin rate that will fully stabilize the bullet, and in some embodiments produce an SG of at least 1.3 or higher, or, in certain embodiments produce an SG of at least 1.5 or higher.

As a projectile travels down-range the SG for the projectile will tend to increase. For example, as the projectile travels down-range the forward velocity of projectile will continually bleed off due to wind resistance against the projectile. At the same time, the spin rate of the projectile will tend to stay approximately the same, or at the very least, decrease at a rate much slower than the forward velocity. As a result, the SG of the projectile will tend to steadily increase as the projectile travels downrange. For example, in some instances a projectile can achieve an SG of 3.0 or greater after only a few seconds of flight. In certain instances a projectile can achieve an SG of 4.0 or greater after several seconds of flight. Additional discussion of gyroscopic stability for various types of projectiles can be found in U.S. Pat. Nos. 4,815,682; 5,932,836; 6,629,669; 7,849,800; and 8,319,164; each incorporated herein by reference in their entirety.

A projectile that has achieved an SG of 3.0 or greater is referred to herein as "over-stabilized", as the projectile has achieved an SG that is at least 33% greater than required for effective projectile flight stability.

When the control mechanism of a spin-stabilized guided projectile attempts to alter the trajectory of the projectile, an over-stabilized guided projectile will provide a greater resistance to the torqueing moment or maneuvering force provided by the control mechanism as compared to a projectile with smaller SG. As such, the over-stabilized projectile will result in slower and less efficient maneuvering, and ultimately result in a reduction in accuracy and effective projectile range.

Consequently, one or more embodiments of the disclosure are directed to controlling an in-flight spin-rate of a spin-stabilized guided projectile by utilizing a calculated stability factor to keep the projectile sufficiently stable for flight, but not over-stabilized. In various embodiments, by actively monitoring and maintaining a SG within a boundary between stable and over-stabilized allows a spin-stabilized guided projectile to achieve performance improvements in improved maneuvering speed and efficiency that would otherwise not be possible if the body spin-rate of the guided projectile was not slowed down. Further, one or more embodiments provide a spin-stabilized guided projectile with improvements to the effective range and overall accuracy due to the improved rate of maneuvers.

In one or more embodiments controlling an in-flight spin-rate of a spin-stabilized guided projectile includes determining a gyroscopic stability factor for the guided projectile using the in-flight spin rate of a chassis of the guided projectile and a forward velocity of the guided projectile. One or more embodiments includes determining a gyroscopic stability factor for the guided projectile using the in-flight spin rate of the chassis and a forward velocity of the guided projectile. Certain embodiments include determining that the gyroscopic stability factor exceeds a stability threshold, and spin-braking the chassis of the guided projectile, in response to determining that the gyroscopic stability factor exceeds a threshold value, by using the one or more power generation components of a guided spin-stabilized projectile to brake the rotation of the collar or other despun control portion, and by which the gyroscopic stability factor of the guided projectile is reduced to a second gyroscopic stability factor.

In one or more embodiments the guided projectile includes a nose portion with a forward tip, a body portion, a tail portion, and a central axis. In various embodiments the projectile includes a chassis extending from the tail portion to the nose portion, the chassis defining a generally cylindrical wall of the body portion and further defining, at the tail portion, a control support portion, the control support portion including a central stub portion having a cylindrical stub sidewall axially centered. In one or more embodiments the projectile includes a despun control portion or collar mounted to the control support portion. In certain embodiments the despun control portion includes a circumferentially and axially extending exterior sidewall with a plurality of aerodynamic surfaces thereon for despinning the despun control portion relative to the chassis and for directional control of the projectile. In one or more embodiments the despun control portion assembly includes one or more power generation components secured to one or more of the despun control portion and the control support portion for providing power generation and for braking of the despun control portion.

The above summary is not intended to describe each illustrated embodiment or every implementation of the present disclosure.

BRIEF DESCRIPTION OF THE SEVERAL VIEWS OF THE DRAWINGS

The drawings included in the present application are incorporated into, and form part of, the specification. They illustrate embodiments of the present disclosure and, along with the description, serve to explain the principles of the disclosure. The drawings are only illustrative of certain embodiments and do not limit the disclosure.

Figure 1:
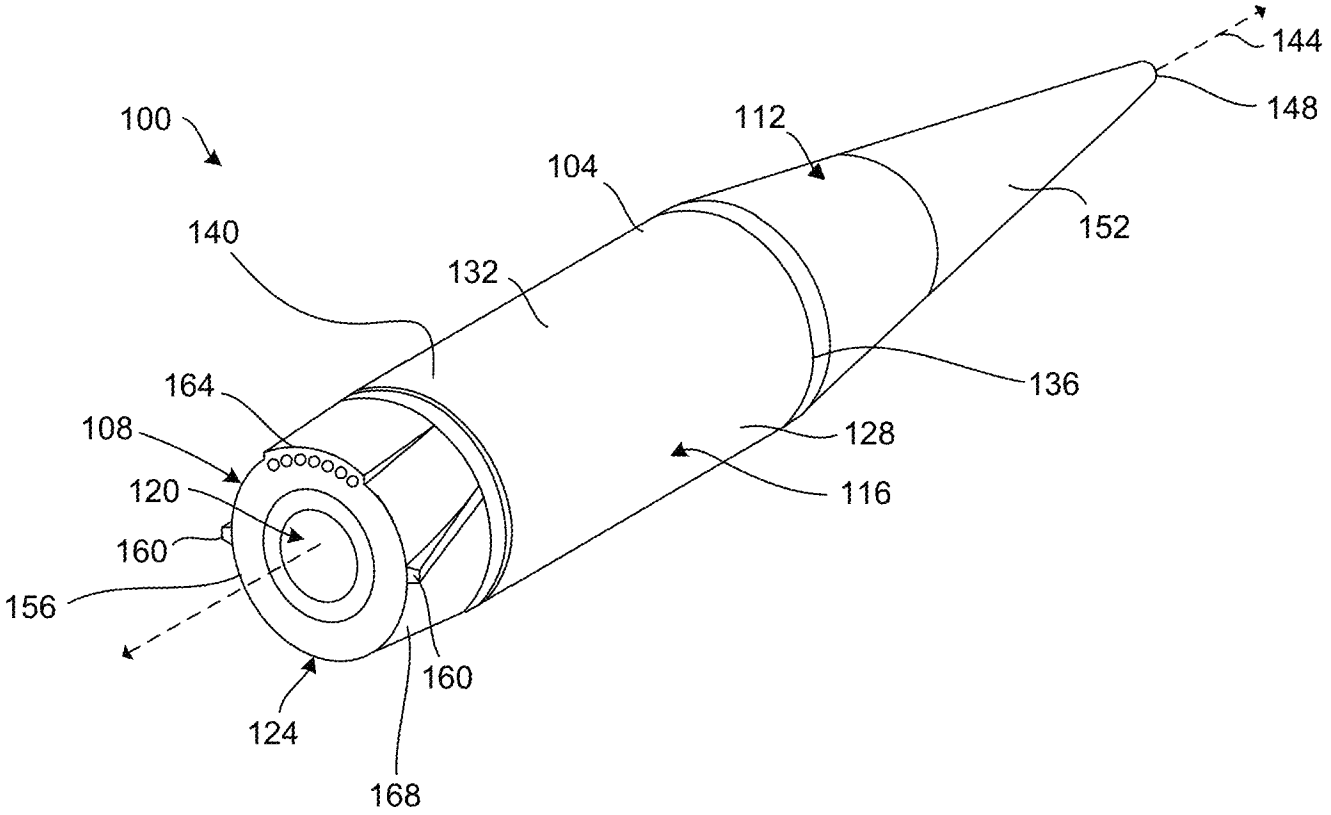
FIG. 1 depicts a rear perspective view of a spin-stabilized guided projectile, according to one or more embodiments of the disclosure.

While the embodiments of the disclosure are amenable to various modifications and alternative forms, specifics thereof have been shown by way of example in the drawings and will be described in detail. It should be understood, however, that the intention is not to limit the disclosure to the particular embodiments described. On the contrary, the intention is to cover all modifications, equivalents, and alternatives falling within the spirit and scope of the disclosure.

DETAILED DESCRIPTION

FIG. 1 depicts a rear perspective view and of a spin-stabilized guided projectile 100 according to one or more embodiments of the disclosure. In various embodiments, the projectile is non-boosted or non-propelled and is fired from a gun. As used herein, the terms "non-boosted", or "non-propelled", means that no active propulsion means such as powered propellers, turbines, jet engines, rocket engines, or propellants are associated with the projectile after it leaves the muzzle of the gun. Rather, a non-boosted or non-propelled projectile includes projectiles that are fired using propellant such as, for example, propellant included in a casing of a cartridge of which the projectile is part or loaded into a barrel with a projectile without the use of a casing. However, in other embodiments the projectile can be boosted or self-propelled, where the projectile includes active propulsion means such as powered propellers, turbines, jet engines, rocket engines, or propellants are associated with the projectile after it leaves the muzzle of the gun.

As used herein, the term "spin-stabilized" means that the projectile is stabilized by being spun around its longitudinal (forward to rearward) central axis. The spinning mass creates gyroscopic forces that keep the projectile resistant to destabilizing torque in-flight. In addition, projectile stability can be quantified by a unitless gyroscopic stability factor (SG). As used herein, SG is quantified by the following equation:

$$SG = \frac{2Lx^2 \cdot \left(\frac{p}{v}\right)^2}{\pi Ly \cdot \rho \cdot Cma \cdot d^3}$$

Where Lx is the axial moment of inertia of a projectile; p is the spin rate of the projectile; v is the velocity of the projectile; Ly is the transverse moment of inertia of the projectile; ρ is the air density; and Cma is the pitching moment coefficient derivative for the projectile; and d is the diameter of the projectile. While the above equation is used herein to quantify the SG for projectiles, SG can be quantified by a variety of different equations or methods. For example, in some instances SG can be quantified differently depending upon the type of projectile. As such, it is contemplated that in various embodiments any suitable equation could be used to quantify SG for a projectile. Further, as used herein, the term "spin-stabilized" additionally refers to projectiles that have a spin rate that is high enough to at least achieve a SG of 1.0 or higher In one or more embodiments, the projectile 100 includes a main body portion 104, a tail portion 108, and a nose portion 112. A chassis 116 extends from the nose portion 112, defines the main body portion 104, and extends to the tail portion 108. The chassis 116 is, in some embodiments, machined or formed from a single block of metal. In some embodiments, the chassis 116 includes a control support portion 120 for supporting a collar assembly 124, which is discussed further below.

In one or more embodiments, the main body portion 104 provides a structure for containing and/or supporting various elements of the projectile 100 including payload and operational components. In certain embodiments, the main body portion 104 has a cylindrical shape or a generally cylindrical shape with one or more tapered portions defined by a main body sidewall 128. In some embodiments, the main body sidewall 128 may be part of the chassis 116 as illustrated, or there may be an additional wall or surface exterior of the chassis 116. In various embodiments the main body portion 104 has an exterior surface 132, a forward portion 136 and a rearward portion 140.

In some embodiments, the main body sidewall 128 includes a tapered portion that converges in a direction along a central axis 144. For example, in some embodiments a first portion, such as the forward portion 136 including some or all of the main body sidewall 128 converges in a forward direction, along central axis 144, towards the nose portion 112. In some embodiments, a second portion, such as the rearward portion 140 including some or all of the main body sidewall 128, could converge in a rearward direction towards the tail portion 108.

In one or more embodiments the chassis 116 defines, at the tail portion 108, the control support portion 120. In various embodiments, the control support portion 120 is a structure that is unitary or integral with the chassis 116 for supporting various components of the projectile 100. In one or more embodiments, the control support portion 120 includes an axially projecting central stub portion for supporting the collar assembly 124 and other elements of the projectile 100. For example, in various embodiments, the central stub portion supports components for internal power generation, braking components, or other components of the projectile 100. In certain embodiments, communication componentry, sensing components, processing components, or other components of the projectile 100 may be located within the control support portion 120, for example, within a cavity formed within the central stub portion.

The nose portion 112 is a forward facing (e.g. in the first direction) structure and has a tapered or a converging shape. The nose portion 112 extends from the forward portion 136 of the main body portion 104, forwardly, in a first direction, along central axis 144 to a forward tip portion 148. In various embodiments, nose portion 112 has an exterior surface 152 and may be conical or have a curved taper from the forward portion 136 of the main body portion 104 to the forward tip portion 148.

In various embodiments, projectile 100 is a medium or high caliber spin-stabilized projectile for firing from a rifled barrel or gun. For example, in certain embodiments, projectile 100 is a 57 mm (millimeter) medium caliber round. In some embodiments, projectile 100 is a 90 mm large caliber round. In certain embodiments, projectile 100 is a small caliber round. As used herein, a medium caliber projectile includes rounds greater than 50 caliber up to about 75 mm, a large caliber projectile includes rounds greater than 75 mm, and small caliber projectiles include rounds less than 50 caliber.

In some embodiments, the main body portion 104 can include a plurality of lift strakes. In one or more embodiments, lift strakes are aerodynamic ridges or fins extending from the main body portion 104 of the spin-stabilized projectile 100. Lift strakes are discussed in further detail in U.S. patent application Ser. No. 15/290,768 entitled "Steerable Projectile with Lift Stakes", which is incorporated by reference herein in its entirety.

In some embodiments, the main body portion 104 of the projectile 100 includes a crimped portion and a band for coupling with a casing of a cartridge. The crimped portion may include various indentations in the chassis 116 that allow for a secure connection between the chassis 116 and the casing of a cartridge. In certain embodiments, the band is constructed of material such as nylon, plastic, copper, or other suitable material and allows for a secure sealing engagement with a rifled barrel of a gun for firing. Crimped portions of a main body portion of a projectile are discussed in further detail in U.S. patent application Ser. No. 15/290,755 entitled "Extended Range Medium Caliber Steerable Projectile", which is incorporated by reference herein in its entirety.

In one or more embodiments, portions of the collar assembly 124 are rotatably mounted to the control support portion 120 and are independently rotatable for despinning with respect to the chassis 116, the main body portion 104, the nose portion 112, and the control support portion 120. In one or more embodiments, the components of the collar assembly 124 include a flight control portion, configured as a collar 156.

In one or more embodiments, the collar 156 of the collar assembly 124 includes a plurality of aerodynamic control surfaces and structures disposed on an external wall. For example, as seen in FIG. 1, collar 156 includes fins or strakes 160 and flap 164. In various embodiments strakes 160 wrap around and extend axially from an exterior surface 168 of the collar 156 in a spiral arrangement configured to despin the collar assembly 124 when the projectile is traveling through the air. In one or more embodiments flap 164 is a section of sidewall raised with respect to the exterior surface 168.

In one or more embodiments, all of the aerodynamic control surfaces, such as the strakes 160 and flap 164 of the collar assembly 124 are all within the axial envelope of the projectile 100 provided by the main body 104. As such, in various embodiments, the aerodynamic control surfaces provide minimal drag while still functioning for despin of the collar 156. For example, in certain embodiments, the collar 156 has a boat tail or tapered shape where the collar 156 tapers rearwardly and the aerodynamic control surfaces, such as flap 164 and strakes 160, are defined by the recessed or tapered exterior sidewall of the collar 156. Put another way, in certain embodiments all the aerodynamic control surfaces are defined by recesses in the collar 156 whereby the outwardly most extending aerodynamic surfaces do not extend radially outward beyond a rearward continuation of the projectile 100 envelope.

Further, in certain embodiments, the rotating collar 156 and associated support components are the only movable components of the projectile 100, and all movable components of the projectile 100 are maintained at all times within the axial envelope of the main body portion 104, thus minimizing drag and extending the effective range of the projectile 100.

In one or more embodiments, the collar assembly 124 includes various components of the spin-stabilized projectile 100. For example, the collar assembly 124 may include components for generating power or electricity in the spin-stabilized projectiles 100. In some embodiments the collar assembly 124 includes power-generation components such as a ring cluster of magnets aligned with a corresponding ring of armature coils, a hydraulic pump electricity generating means, or other power generating components. In some embodiments, the collar assembly 124 includes a battery or other power storage components.

Projectiles with a collar assembly having internal components are discussed in further detail in U.S. patent application Ser. No. 15/290,755 entitled "Extended Range Medium Caliber Steerable Projectile", which is incorporated by reference above.

In operation, the projectile 100 can be loaded into a projectile delivery system, such as a gun with a rifled barrel, and fired. The projectile 100 may be fired at various muzzle velocities and at various muzzle spin rates based on the propellant used and the design (e.g. rifling) of the projectile delivery system. For example, in one or more embodiments, the projectile 100 is fired having an initial spin rate of 1300 Hz±100 Hz. In various embodiments, when fired, the initial spin rate of the projectile 100 is substantially within the range of 800 Hz-2000 Hz.

In various embodiments, when fired, the interaction of the aerodynamic control surfaces with oncoming wind or air cause the collar assembly 124 to despin relative to the main body portion 104, the nose portion 112, and the control support portion 120. In various embodiments the spin rate of the collar assembly 124 causes a relative rotation of the power-generation components for powering the components of the projectile 100.

In one or more embodiments, when fired, the spin rate of the collar assembly 124 is about 1300 Hz±100 Hz. In various embodiments, when fired, the spin rate of the collar assembly 124 is substantially within the range of 800 Hz-2000 Hz.

In operation, the collar assembly 124 is configured for resistive breaking, using power-generation components, to control the spin rate of the collar assembly 124 and/or the spin rate of the remainder of the projectile 100. For example, in some embodiments resistive breaking may be used to control the despin of the collar assembly 124 to a spin rate of approximately 0 Hz relative to the earth. In some embodiments, the resistive braking could be used to completely brake the despin of the collar assembly 124 with respect to the chassis 116. In certain embodiments, resistive braking may be used to slow but not stop the despin of the collar assembly 124 with respect to the chassis 116. For example, resistive braking could be configured to brake the spin rate of the collar to some percentage of the spin rate of a fully unbraked collar.

By controlling the spin rate, the collar assembly 124 may be used to provide a moment or maneuvering force on the projectile 100 for altering trajectory, speed, or other flight characteristics of the spin-stabilized projectile 100. For example, in one or more embodiments, by controlling the spin rate the collar assembly 124 may be used to control the orientation of the flap 164 or other aerodynamic control surfaces to act as a foil for aerodynamically providing a moment on the projectile 100. As such, the orientation of the projectile 100 can be torqued by the moment or maneuvering force to control the in-flight trajectory of the projectile 100.

As a consequence of the ability to control the in-flight trajectory of the projectile 100, in various embodiments, the collar assembly 124 extends the effective range of the projectile 100 by using the collar assembly 124 to compensate for various environmental/in-flight factors that influence the projectile off its originally aimed path and to otherwise steer the projectile to its target. In some embodiments, the collar assembly 124 can dramatically extend the effective range of the projectile compared to that of a non-guided spin-stabilized projectile. In addition, in various embodiments the ability to control the in-flight trajectory of the projectile 100 improves projectile accuracy by using the collar assembly 124 to compensate for moving targets, to compensate for aiming errors, or for other scenarios that would normally result in a projectile miss.

In addition, in various embodiments, by braking or slowing the spin rate of the collar assembly 124, the spin rate of the remainder of the projectile 100 is slowed. For example, in various embodiments, engaging a resistive braking force between the control support portion 120 and the collar assembly 124 results in rolling resistance on the rotational motion of the tail portion 108 that slows the spin rate of the chassis 116 that includes the tail portion 108, main body portion 104, and the nose portion 112. In addition, in various embodiments, engaging a resistive braking force between the control support portion 120 and the collar assembly 124 causes the interaction of the aerodynamic control surfaces with oncoming wind or air cause the collar assembly 124 to counteract the rotation of the chassis 116, as the orientation of the aerodynamic control surfaces that would normally despin the collar generate a counter-rotational force with the oncoming air that slows the spin rate of the projectile 100.

While FIG. 1 and other figured described below depict a projectile 100 having a rearwardly positioned collar assembly 124 and collar 156, in various embodiments the projectile 100 can instead include a despun control portion positioned in main body portion 104, nose portion 112, or in other portion of the projectile 100, where the despun control portion is configured for despinning relative to the chassis 116 and for directional control of the projectile 100.

In addition, while the despun control portion may, in some embodiments, be designed as a collar, in certain embodiments the despun control portion may utilize other types of designs suitable for directional projectile control. Further, in certain embodiments, the despun control portion may include fixed or non-fixed aerodynamic features such as deployable or actuatable fins, canards, and strakes.

Referring to FIGS. 2A-2D, side views of the projectile 100 in-flight are depicted according to one or more embodiments of the disclosure. As described above, projectile 100 includes a chassis 116 including a tail portion 108, main body portion 104, and a nose portion 112. In addition, projectile 100 includes a collar assembly 124 including a collar 156 rotatably mounted to a control support portion of the tail portion 112. The collar 156 includes a plurality of aerodynamic control surfaces that are configured to despin the collar 156 with respect to the chassis 116 in-flight. FIGS. 2A-2D depict a reference system that includes a horizontal plane 204 and a vertical plane 208 that intersect through the projectile 100. In addition, arrows 212 are depicted indicating a direction of the relative motion of the air through which the projectile 100 is traveling. As shown in FIGS. 2A-2D the relative motion of the air is parallel to the horizontal plane 204.

Figure 2A:
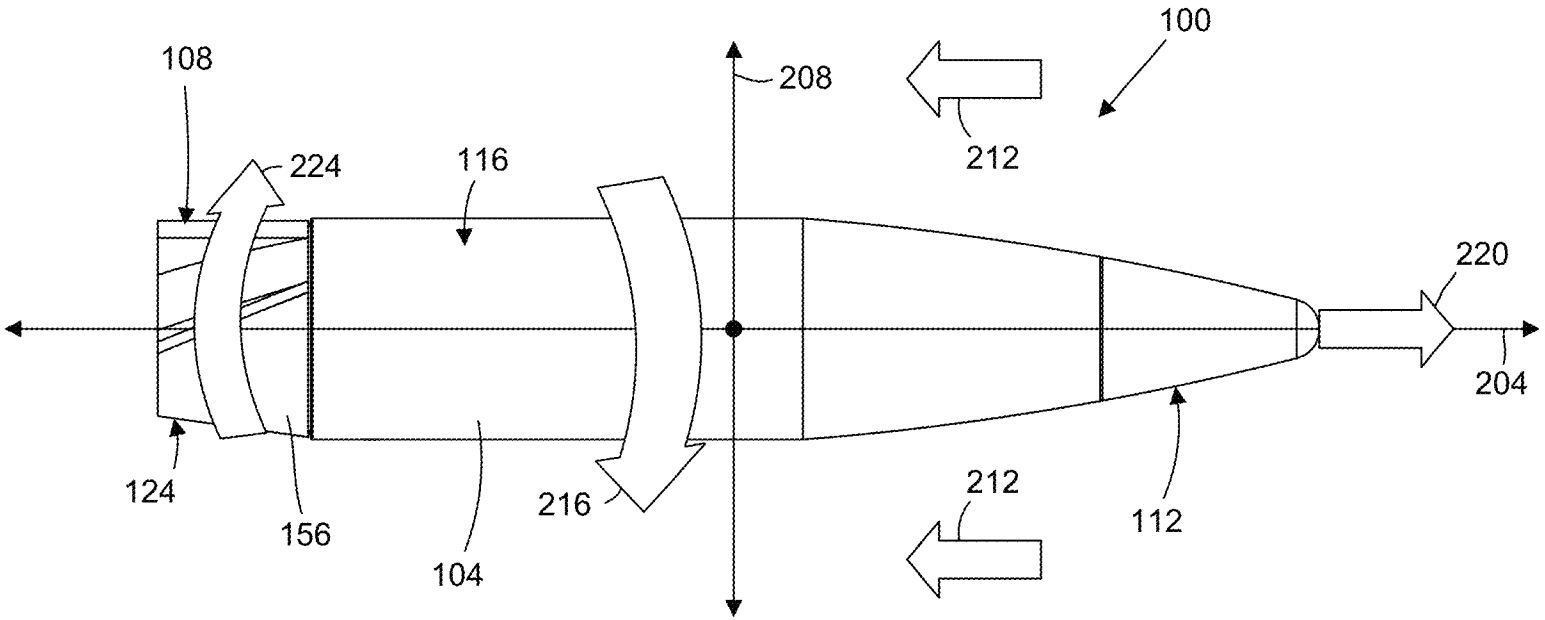
FIGS. 2A-2B depict the spin-stabilized guided projectile in-flight after being fired from a rifled barrel, according to one or more embodiments of the disclosure.

In FIG. 2A, the projectile 100 has been initially fired from a rifled barrel. The projectile 100 is traveling substantially on the horizontal plane 204 in a forward direction and at an initial velocity or muzzle velocity. As a result of the spin imparted from the rifled barrel, the chassis 116 is spinning about the longitudinal axis of the projectile 100 in a direction indicated by arrow 216 at an initial spin rate or muzzle spin rate. Due to the rotational or spinning motion of the chassis 116, the projectile 100 possesses an initial angular momentum in a direction indicated by arrow 220. As described above, in one or more embodiments, the initial spin rate of the chassis 116 is about 1300 Hz±100 Hz. In various embodiments, the initial spin rate of the chassis 116 is substantially within the range of 800 Hz-2000 Hz.

In one or more embodiments, the projectile is fired at a muzzle velocity and a first spin rate that results in an initial SG or muzzle SG of at least 1.0. In certain embodiments, the projectile 100 is fired at a muzzle velocity and at a first spin rate that results at an SG of at least 1.3. In some embodiments, the projectile 100 is fired at a muzzle velocity and at a first spin rate that results at an SG of at least 1.5.

In addition, the plurality of aerodynamic control surfaces have despun the collar 156 with respect to the chassis 116. As such, the collar 156 is spinning in a second direction about the longitudinal axis of the projectile 100 indicated by arrow 224 and at a collar spin rate. As described above, in one or more embodiments, the collar spin rate is about 1300 Hz±100 Hz with respect to the earth. In some embodiments, the collar spin rate is substantially within the range of 800 Hz-2000 Hz with respect to the earth.

In various embodiments, after several moments of flight, the projectile 100 has lost some amount of forward velocity due to drag and is traveling at a second velocity that is slower than the initial velocity described above. In addition, the chassis 116 has continued to spin about the longitudinal axis of the projectile 100 in a direction indicated by arrow 204. In various embodiments, after several moments of flight, while the projectile 100 has lost forward velocity, the chassis 116 is spinning at a second spin rate that is substantially the same as the initial spin rate described above. In certain embodiments, the second spin rate is less than the initial spin rate, but has decreased at a lower rate than as compared to the rate of decrease between the initial velocity and the second velocity.

In various embodiments, as a result of the changes to the forward velocity and/or the spin rate of the chassis 116, the SG of the projectile has increased in-flight from the initial SG to a second SG. In certain embodiments, this increase results in the second SG being greater than 2.0. In some embodiments, this increase results in the second SG being substantially in the range of 2.0-3.0. In certain embodiments this increase results in the second SG being 3.0 or higher.

Figure 2B:
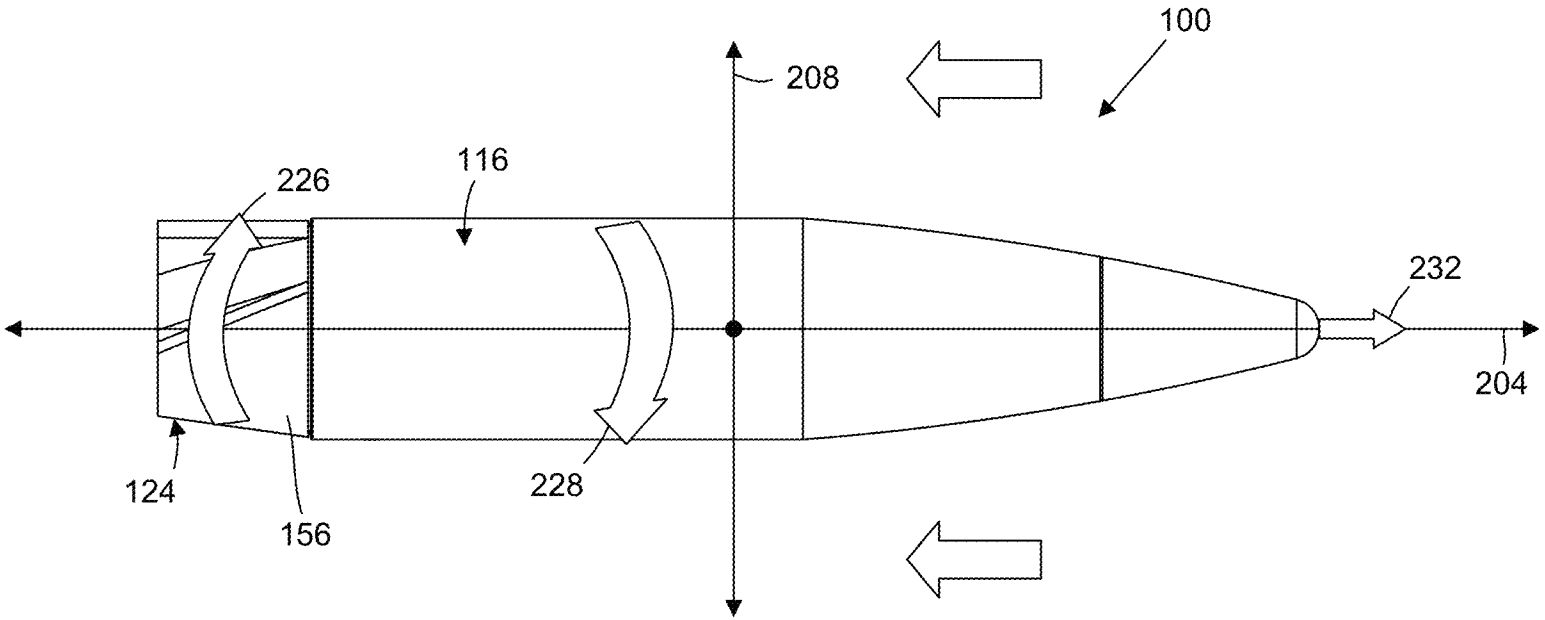

In FIG. 2B, a braking force has been applied to the collar assembly 124 slowing the relative rotation of the collar 156 about the longitudinal axis and with respect to the chassis 116. As a result, the collar 156 is spinning in the second direction but at a second collar spin rate, indicated by arrow 226, that is smaller than the initial collar spin rate described with regard to FIG. 2A.

As described above, in various embodiments the collar 156 is braked by engaging a resistive braking force between the control support portion of the tail portion 108 and the collar 156. Further, in some embodiments, as a consequence of the braking force between the control support portion, the collar is spin-braked such that rolling resistance on the rotational motion of the chassis 116 is increased and/or the interaction of the aerodynamic surfaces on the braked collar and the oncoming air operates to slow the spin rate of the chassis 116 and ultimately the projectile 100. As such, projectile 100 depicted in FIG. 2B is rotating at a third spin rate, indicated by arrow 228, that is smaller than the second spin rate or the initial spin rate described above with reference to FIG. 2A.

In various embodiments, due to the rotational or spinning motion of the chassis 116 at the third spin rate, the projectile 100 possesses reduced angular momentum in the direction indicated by arrow 232 as compared to the initial angular momentum generated by the initial spin rate of the chassis depicted in FIG. 2A.

Described further below, in various embodiments the collar 156 is spin braked to keep the SG of the projectile 100 within an acceptable range of SG values during flight. For example, in some embodiments the projectile 100 includes various sensors and/or electronic circuitry for calculating the SG for the projectile 100 based, for example, on sensor data of the forward velocity and spin rate of the projectile while in-flight. In certain embodiments, if the calculated SG for the projectile exceeds some stability threshold value known to the projectile 100, then the projectile 100 will initiate spin-braking in the collar 156, as described above, to slow the spin rate of the projectile 100 and thereby lowering the SG value.

For example, in some embodiments, the projectile 100 could be configured to initiate spin-braking once the SG for the projectile has reached an SG of at least 2.5. In certain embodiments the projectile 100 could be configured to initiate spin-braking once the SG for the projectile has reached an SG of 3.0. However, it is contemplated that any suitable SG value could be selected as the stability threshold value.

In various embodiments, the projectile 100 continually monitors the SG value for the projectile 100 during flight to determine when to initiate spin-braking and when to halt spin-braking.

For example, in certain embodiments, the projectile 100 is configured to cease the spin-braking of the collar 156 once the SG no longer exceeds the stability threshold. In some embodiments the projectile 100 is configured to halt the spin-braking of the collar 156 once the SG has reached a target stability value that is separate from the stability threshold value. For example, in some embodiments, the projectile 100 could be configured to initiate spin braking when the SG for the projectile exceeds a stability threshold value of 2.5. At the same time the projectile 100 could be configured to cease spin-braking once the SG value for the projectile reaches a target value of 2.0, or other suitable value.

In certain embodiments, described further below, the magnitude or extent of spin-braking can vary. For example, in some embodiments, the collar could be spin-braked to completely stop of the despinning rotation of the collar 156 with respect to the chassis 116. In some embodiments, the braking could be configured to brake the spin rate of the collar to some percentage of the spin rate of a fully unbraked collar. For example, in some embodiments the collar 156 could have its rotation with respect to the chassis braked to some percentage (e.g. 50%, 80%, or other value) of the rate an unbraked collar.

In some embodiments, the magnitude of spin-braking corresponds to the SG value for the projectile. For example, in certain embodiments, the projectile is configured to brake the collar 156 at a higher magnitude for higher SGs and to decrease the magnitude of braking as the SG decreases.

In one or more embodiments, as a result of the spin-braking, the third spin rate is small enough such that the SG for the projectile 100 in FIG. 2B is less than 3.0. In some embodiments, the third spin rate is small enough that the SG for the projectile 100 in FIG. 2B is less than 2.5. In certain embodiments, the third spin rate for the SG for the projectile 100 in FIG. 2B is less than 2.0.

Figure 2C:
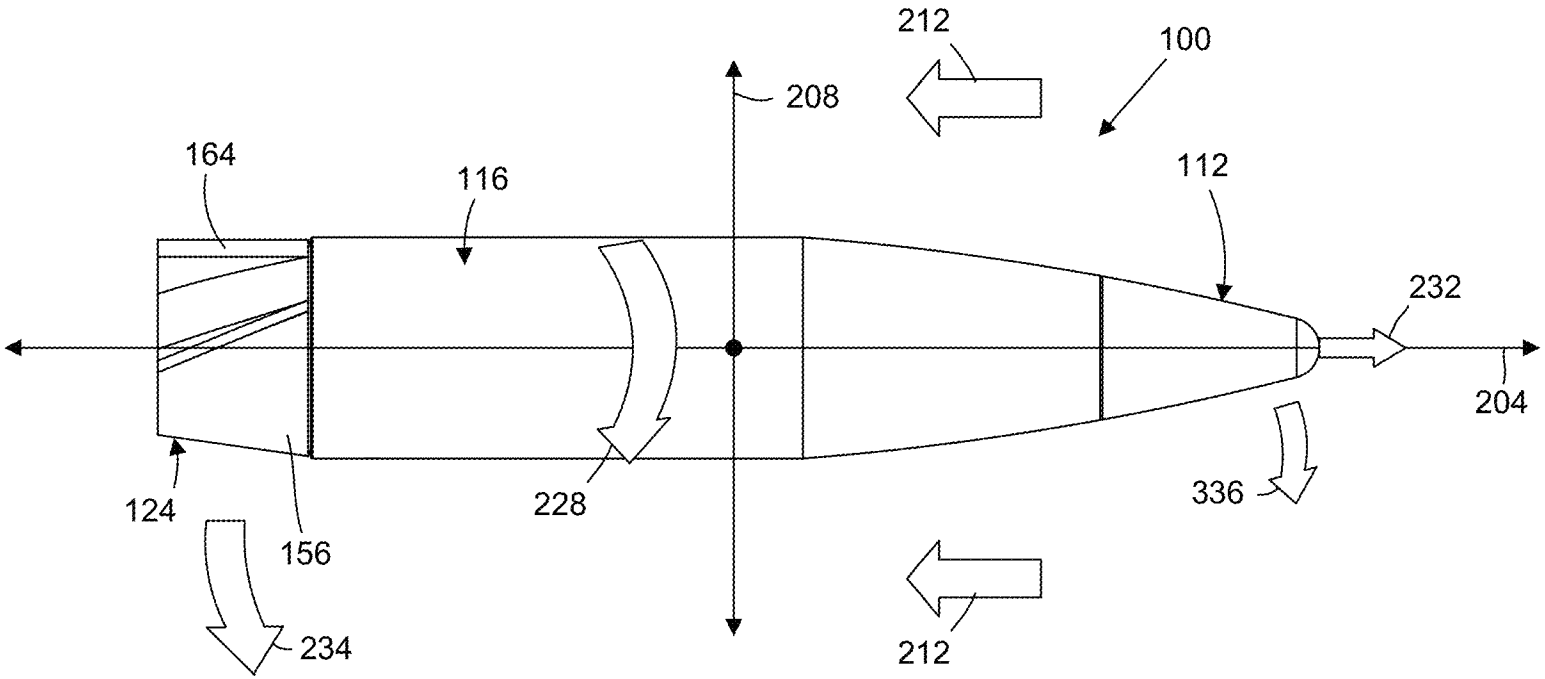
FIGS. 2C-2D depict the spin-stabilized guided projectile in-flight with the control mechanism providing a moment on the projectile to alter the trajectory of the projectile.

In FIG. 2C, subsequent to the spin-braking depicted FIG. 2B, a braking force has been applied to the collar assembly 124 to stop the rotation of the collar assembly with respect to the earth. With the orientation depicted in FIG. 2C, the flap 164 applies a moment on the rear of the projectile 100 that pitches the nose portion 112 of the projectile 100 upwardly relative to the horizontal plane 204. However, the projectile 100 resists the upward pitching of the nose portion 112 due to the gyroscopic stability of the projectile 100. For example, the angular momentum formed as a result of the spinning motion of the projectile 100 about its longitudinal axis works to resist the upwards pitching movement of the nose portion 112. As such, the gyroscopic stability of the projectile generally serves to slow or reduce the efficiency of projectile maneuvers. For example, each projectile maneuver requires a moment or force, indicated by arrow 234 that is sufficient to overcome a partially countervailing force, indicated by arrow 336, from the gyroscopic stability of the projectile, in order to make a turn or maneuver.

However, because the projectile 100 is now spinning at the third spin rate, the SG of the projectile 100 has been reduced from being over-stabilized to having an SG of less than 3.0. As a result, maneuvers are more optimized, occurring at reduced gyroscopic stabilities and thereby increasing the overall speed and efficiency of the maneuvers.

Figure 2D:
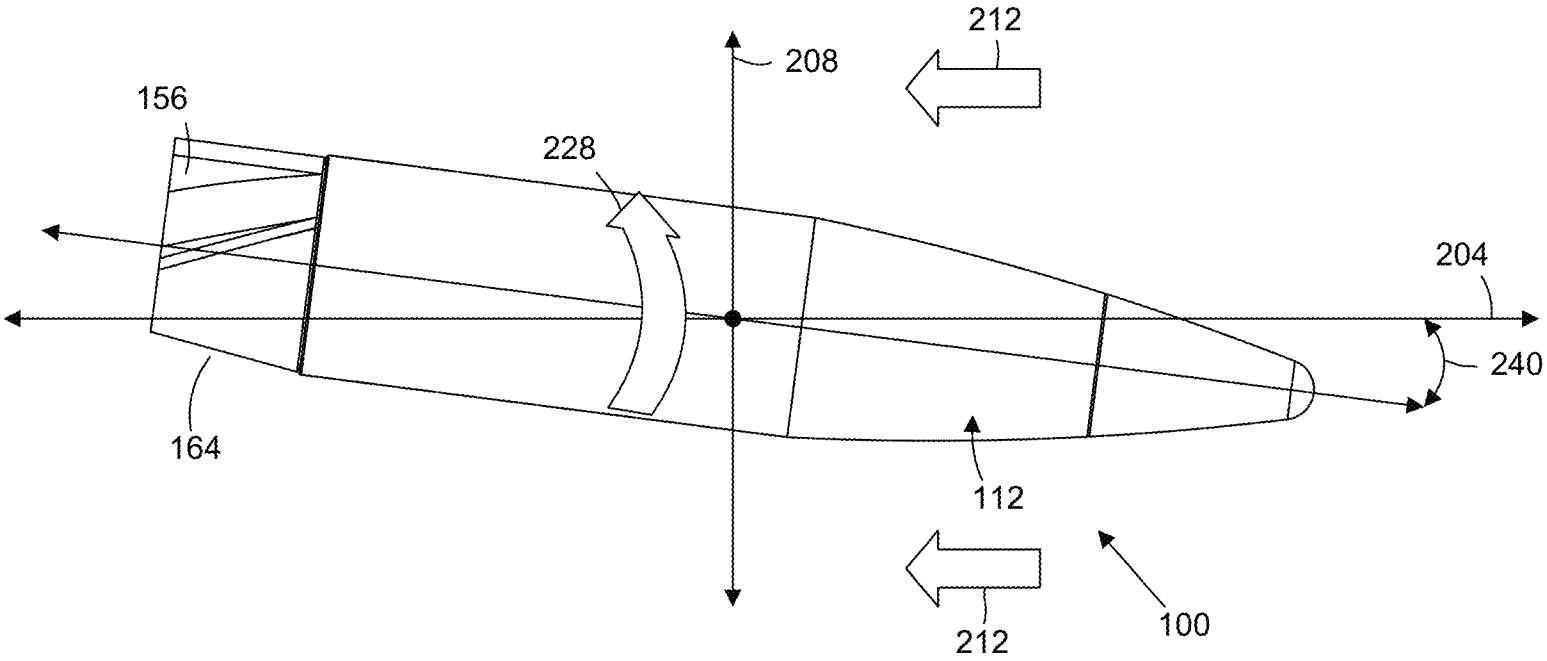

Referring to FIG. 2D, as a result of the pitching moment applied to the projectile 100, an angle of attack 240 is increased for the projectile 100 to alter the trajectory of the projectile.

As used herein, the angle of attack 240 is the angle between the longitudinal axis of the projectile 100 and the direction of the relative motion of the air through which the projectile 100 is moving, in this instance, a direction parallel to the horizontal axis 204. In various embodiments, the angle of attack 240 corresponds to the magnitude of and the direction of drag force that is applied to the projectile 100 by the oncoming air. For example, depicted in FIG. 2D, the nose of the projectile is pitched downwardly relative to the horizontal plane 204, to create the angle of attack 240 that applies a lifting force or drag force to the projectile 100 upwardly in the vertical plane 208. Additionally or alternatively, in some instances, the nose of the projectile 100 could be yawed in the horizontal plane 204 to create an angle of attack that applies drag force to the projectile 100 in one of the lateral directions of the horizontal plane 204 (e.g. directions into or out of the page of FIG. 2D). Generally, as the angle of attack increases, oncoming air is deflected through a larger angle and the directional component of the airstream velocity increases, resulting in more drag force applied to the projectile.

While, in FIG. 2D, the nose of the projectile 100 is pitched downwardly to create a lifting force on the projectile 100, in other embodiments the projectile 100 could pitch upwardly to create an upward lifting force based on the center of mass, center of pressure, or other aerodynamic characteristics of the projectile 100.

Figure 3A:
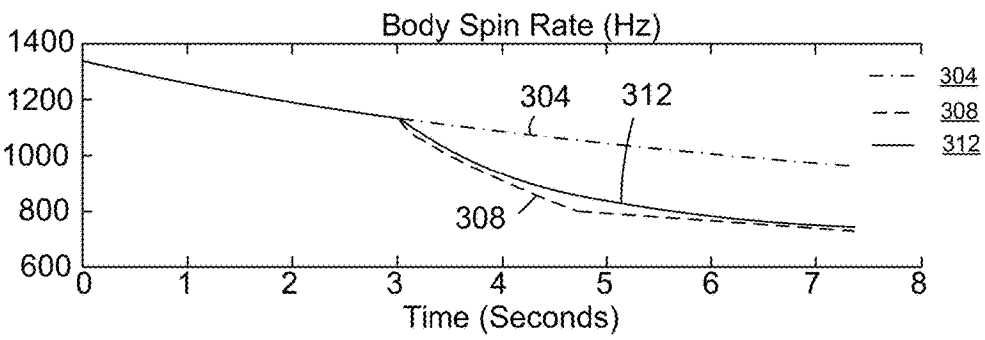
FIG. 3A-3C depict charts plotting gyroscopic stability factor, spin rate, and spin-braking magnitude for three computer model simulations of spin-stabilized projectiles, according to one or more embodiments of the disclosure.
Figure 3B:
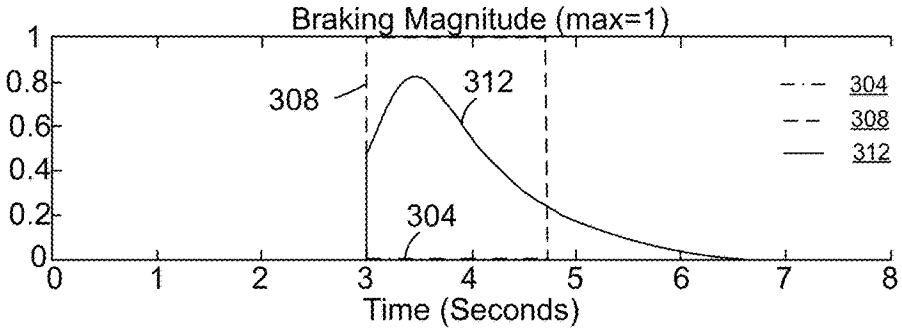
Figure 3C:
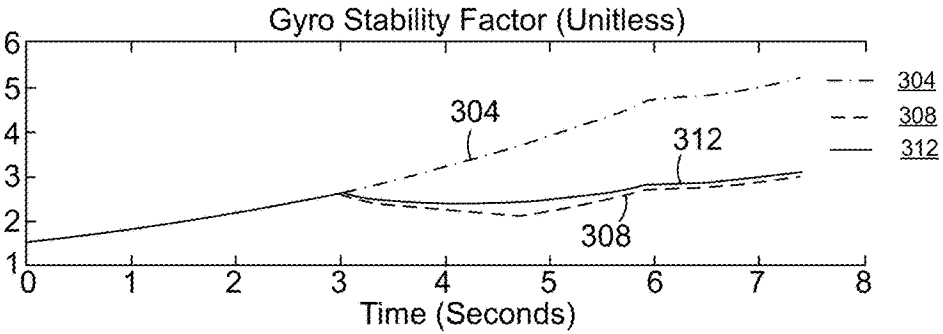

Referring to FIGS. 3A-3C, charts are depicted showing the results of three computer model simulations 304, 308, 312 of a spin-stabilized guided projectile according to one or more embodiments of the disclosure. More specifically, each chart plots one or more flight characteristics of the guided projectile measured during the course of three simulated flights each lasting about seven seconds.

In FIG. 3A, the body spin rate of the guided projectile, measured in hertz (Hz), is plotted versus the simulated in-flight time. In FIG. 3B, the magnitude of spin-braking for the collar of the guided projectile is plotted versus the simulated in-flight time. As depicted on the chart of FIG. 3B, the magnitude of spin-control braking is represented as a number between 0 and 1 where 1 indicates that the collar is fully braked and where 0 indicates that the collar is fully unbraked and despinning freely with respect to the main body of the projectile. For example, a magnitude of 0.5 would indicate that the collar is 50% braked with respect to the main body portion, a magnitude of 0.8 would indicate that the collar is 80% braked with respect to the main body portion, and so on. In FIG. 3C, the gyroscopic stability factor (SG) for the projectile is plotted versus the simulated in-flight time.

In certain embodiments the magnitude of spin-control braking refers to the percentage of reduction of collar despin. For example, in certain embodiments, a magnitude equal to 1 would represent that the collar has been fully-braked with respect to the main body of the projectile and, as such, is no longer despun and is spinning in line with the remainder of the projectile. However, in some embodiments, the magnitude of spin-control braking refers to the extent of braking capability for the collar. For example, a magnitude equal to 1 would represent that the projectile brake is braking to the full extent of the internal braking components in the projectile. As such, in those instances, while the extent of braking force may be fully applied that may not correspond to a full stopping of the collar with respect to the remainder of the projectile. Consequently, in certain embodiments a braking magnitude equal to 1 may not indicate that the collar is fully braked with respect to the main body portion of the projectile.

In FIGS. 3A-3C, the projectile is initially fired at the zero second time mark. In each simulation, the main body portion of the projectile has an initial spin rate of about 1300 Hz, the collar in each simulation is fully unbraked, and the projectiles are fired having an initial SG of about 1.5. As the projectile travels downrange, the spin rate of the main body portion degrades, slowing to about 1150 Hz at the three second flight-time mark. However, as described above, while the spin rate of the main body portion decreases, the SG of the projectile increases, reaching a SG of about 2.75 at the three second mark.

At the three second mark, each of the three simulations 304, 308, 312 diverge from one another with regard to spin rate and SG, as each simulation implements a different measure of spin-braking.

As shown in FIG. 3B, the first simulation 304 depicts a control simulation of projectile flight where no spin-control braking occurs and the projectile flies like a typical guided projectile. As a result, the body spin rate decreases at a consistent rate from the initial spin rate at time zero to the end of the simulation at about the seven second time mark. For example, as shown in FIG. 3A, the body spin rate decreases at a rate of about 50 Hz per second from time zero to the three second time mark (e.g. from an initial spin rate of 1300 Hz to a spin rate of about 1150 Hz) and at substantially the same rate of 50 Hz per second from the three second mark to the end of the simulation 304 at the seven second mark (e.g. from a spin rate of about 1150 Hz to a spin rate of about 950 Hz).

As an additional result, shown in FIG. 3C, the SG for the first simulation 304 keeps increasing from the initial SG at the zero time mark until the end of the simulation 304 at the seven second time mark. For example, the projectile in the first simulation 304 reaches a SG of about 2.5 at the three second time mark, reaches an SG exceeding 3.0 at about the three and a half second time mark, and steadily increases to an SG of about 5.0 at the seven second time mark.

As described above, although the body spin rate of the projectile is decreasing, the decrease in body spin rate in the first simulation 304 is outstripped by the decrease in the projectile's forward velocity. As such, without any spin-braking of the projectile, the result is a steady increase in the SG over the seven seconds of simulated flight. Further, the increase in the SG is sufficiently high enough that the projectile has an SG exceeding 2.0 after only about one second of flight and has an SG at or exceeding 3.0 after only about three and a half seconds of flight.

The second simulation 308 depicts a simulation of projectile flight where the collar assembly 308 is fully braked at the three second time mark and is then fully unbraked at the four and three quarter second time mark. For example, referring again to FIG. 3B, the projectile has a braking magnitude of 1.0 at the three second mark which then drops to a braking magnitude of 0.0 at the four and three quarter second mark.

FIG. 3A shows the result of this spin-rate braking on the spin rate of the projectile in the second simulation 308. At the three second mark, when the braking magnitude of 1.0 is initiated, the spin rate begins to decrease at a much faster rate than the 50 Hz per second decrease associated with the control simulation described above.

For example, during the time period where the braking magnitude is 1.0, the spin rate of the projectile decreases at a rate of about 200 Hz per second (e.g. from 1150 Hz to about 800 Hz over 1.75 seconds).

Referring again to FIG. 3C, the SG for the projectile in the second simulation 308 decreases during the time period when the collar is spin-braked. For example, the SG drops from approximately 2.75 at the three second time mark to an SG of approximately 2.0 at the four and three quarter second time mark. This is an approximately 30% decrease in the SG over the course of the braking period. Further, this is in significant contrast to the results of the first simulation 304, described above, where the SG of an unbraked projectile instead increases by 20% over the same time period.

When the collar is fully unbraked at the four and three quarter second time mark, the spin rate of the projectile resumes a rate of spin rate decrease that is similar to the first simulation 304 (e.g. a decrease of about 50 Hz per second). In addition, the SG of the projectile again begins to increase from approximately 2.0 at the four and three quarter second time mark to a SG of approximately 2.5 at the end of the simulation.

Thus, as a result of the spin-control braking in the second simulation 308, the SG of the projectile is significantly decreased as compared to the projectile in the first simulation 304 above. For example, while the projectile in the first simulation 304 has an SG that exceeds 3.0 after about the three and a half second time mark, the SG of the projectile in the second simulation 308 is instead kept under 3.0 for the entirety of the simulation. As a result, any projectile maneuvers that are performed by the projectile in the second simulation 308 will occur faster and more efficiently than compared to the projectile in the first simulation 304.

The third simulation 312 depicts a simulation of projectile flight where the projectile collar is spin-braked starting at the three second time mark with a variable magnitude that changes over the course of the simulated flight. For example, referring again to FIG. 3B, at the three second time mark the collar of the projectile is spin-braked at a magnitude of 0.5. From the three second time mark to the three and a half second time mark the magnitude is gradually increased to a magnitude of approximately 0.8. Subsequently, the braking force is gradually decreased from a magnitude of 0.8 to a magnitude of 0.5 again at the four second time mark. After that, the braking magnitude is gradually decreased from 0.5 at the four second time mark to become fully unbraked at about the six and a half second time mark.

FIG. 3A shows the result of this spin-rate braking in the third simulation 312. At the three second time mark, when the braking magnitude of 0.5 is initiated, the spin rate begins to decrease at a faster rate than the 50 Hz per second decrease associated with the control simulation described above.

For example, during the time period where the braking magnitude is being increased from 0.5 to about 0.8, the spin rate of the projectile decreases at a rate of about 300 Hz per second (e.g. from 1150 Hz to about 1000 Hz over half a second). During the time period where the braking magnitude is being decreased from 0.8 back to 0.5, the spin rate of the projectile decreases at a rate of about 200 Hz per second (e.g. from about 1000 Hz to about 900 Hz over half a second).

In some embodiments, once the braking magnitude drops below 0.5, the decrease in the spin rate begins to become less significant and begins to match the decrease in the spin rate of the projectile in the first simulation. For example, from the four second time mark to the seven second time mark the spin rate of the projectile decreases at a rate of about 50 Hz (e.g. from about 900 Hz to about 750 Hz over three seconds).

Referring again to FIG. 3C, the third simulation 312 demonstrates that the SG for the projectile decreases during the time period when the collar is spin-braked to a magnitude of at least 0.5.

For example, while the magnitude of spin-braking is between 0.5 and 0.8 the SG value for the projectile drops from approximately 2.75 at the three second time mark to an SG of approximately 2.5 at the four second time mark. This is an approximately 10% decrease in the SG over the course of the braking period. Further, this is again in contrast to the results of the first simulation 304, described above, where the SG instead increases by 20% over the same time period of the simulation.

When the collar is spin-braked at a magnitude less than 0.5, the spin rate of the projectile resumes a rate decrease that is similar to the first simulation 304 (e.g. a decrease of about 50 Hz per second). In addition, the SG of the projectile begins to increase again from approximately 2.5 at the four second time mark to a SG of approximately 3.0 at the end of the simulation.

Thus, as a result of the spin-braking of the third simulation 312, the SG of the projectile is significantly decreased as compared to a projectile without spin-braking. For example, while the projectile in the first simulation has an SG that exceeds 3.0 after about the three and a half second time mark, the SG of the projectile in the second simulation is instead kept under 3.0 for the entirety of the simulated flight.

While FIGS. 3A-3C and the second and third simulations 308, 312 demonstrate two different examples of spin-braking various other measures of spin-braking are contemplated as within the scope of the disclosure. For example, variations in spin-braking could include differences in the magnitude of braking, the triggers at which spin-braking is initiated and/or ended, and variations in other factors are all contemplated as within the scope of the disclosure.

Figure 4:
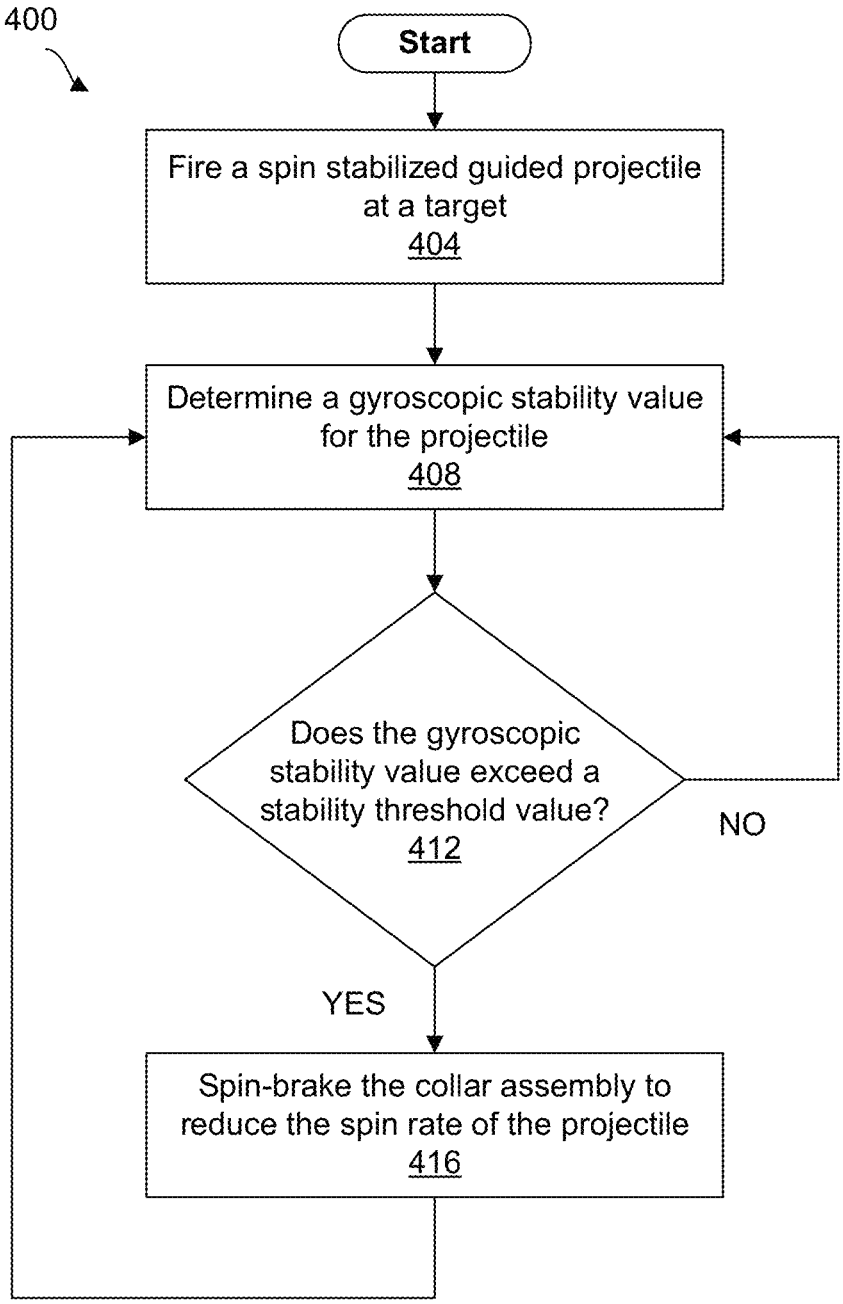
FIG. 4 depicts a flowchart diagram of a method of controlling an in-flight spin-rate of a spin-stabilized guided projectile is depicted according to one or more embodiments of the disclosure.

Referring to FIG. 4 a flowchart diagram of a method 400 of controlling an in-flight spin-rate of a spin-stabilized guided projectile is depicted according to one or more embodiments.

In one or more embodiments, the method 400 includes, at operation 404 firing a spin-stabilized guided projectile at a target. As described above, in one or more embodiments the projectile can be loaded into a projectile delivery system, such as a gun with a rifled barrel, and fired. The projectile may be fired at various muzzle velocities and at various muzzle spin rates based. For example in one or more embodiments the projectile is fired having an initial spin rate of 1300 Hz±100 Hz. In some embodiments, the initial spin rate of the projectile is substantially within the range of 800 Hz-2000 Hz. In various embodiments, the projectile is fired having sufficient spin rate such that the projectile is at least initially spin-stabilized, having an SG of 1.0 or higher. In certain embodiments the projectile is fired having an initial spin-rate sufficient to achieve an SG substantially within the range of 1.3-2.0.

In various embodiments, the interaction of the control portion of the guided projectile with oncoming wind or air cause the control portion of the projectile to despin relative to the remainder of the projectile. In various embodiments the spin rate of the collar assembly causes a relative rotation of the power-generation components for powering the components of the projectile.

In one or more embodiments, when fired, the spin rate of the despun control portion is about 1300 Hz±100 Hz. In various embodiments, when fired, the spin rate of the despun control portion is substantially within the range of 800 Hz-2000 Hz.

In various embodiments, the method 400 includes, at operation 408, determining a gyroscopic stability for the projectile. As described above, projectile stability can be quantified by a gyroscopic stability factor (SG). In various embodiments SG can be quantified according to various different methods depending on the type of projectile. However, in various embodiments, SG is typically based at least in part on a ratio of the spin-rate of the projectile to the forward velocity of the projectile. As such, in one or more embodiments the higher the spin-rate of the projectile, as compared to its velocity, the greater the SG. Conversely, in certain embodiments the higher the velocity of the projectile, as compared to its spin-rate, the lesser the SG.

For example, in some embodiments the projectile includes various sensors and/or electronic circuitry for calculating the SG for the projectile based, for example, on sensor data of the forward velocity and spin rate of the projectile while in-flight. In various embodiments, the projectile continually monitors the SG value for the projectile during flight to determine when to initiate spin-braking and when to halt spin-braking.

In one or more embodiments, the method 400 includes, at decision block 412, determining whether the gyroscopic stability exceeds a stability threshold. In various embodiments the projectile has a known or determined range of acceptable SG values for flight. As such, in decision block 412, if the gyroscopic stability exceeds the stability threshold, then the method 400 proceeds to operation 416 where the method 400 includes spin-braking the collar of the projectile to reduce the spin rate of the projectile. As described above, by slowing the spin rate of the projectile the SG value of the projectile is lowered. Once the projectile has been spin braked, the method 400 returns to operation 408 as the method continuously monitors the gyroscopic stability value of the projectile for additional spin braking if necessary. For example, if, in decision block 412, the gyroscopic stability does not exceed the stability threshold, then method 400 returns to operation 408 where the method 400 includes determining the gyroscopic stability for the projectile.

Figure 5:
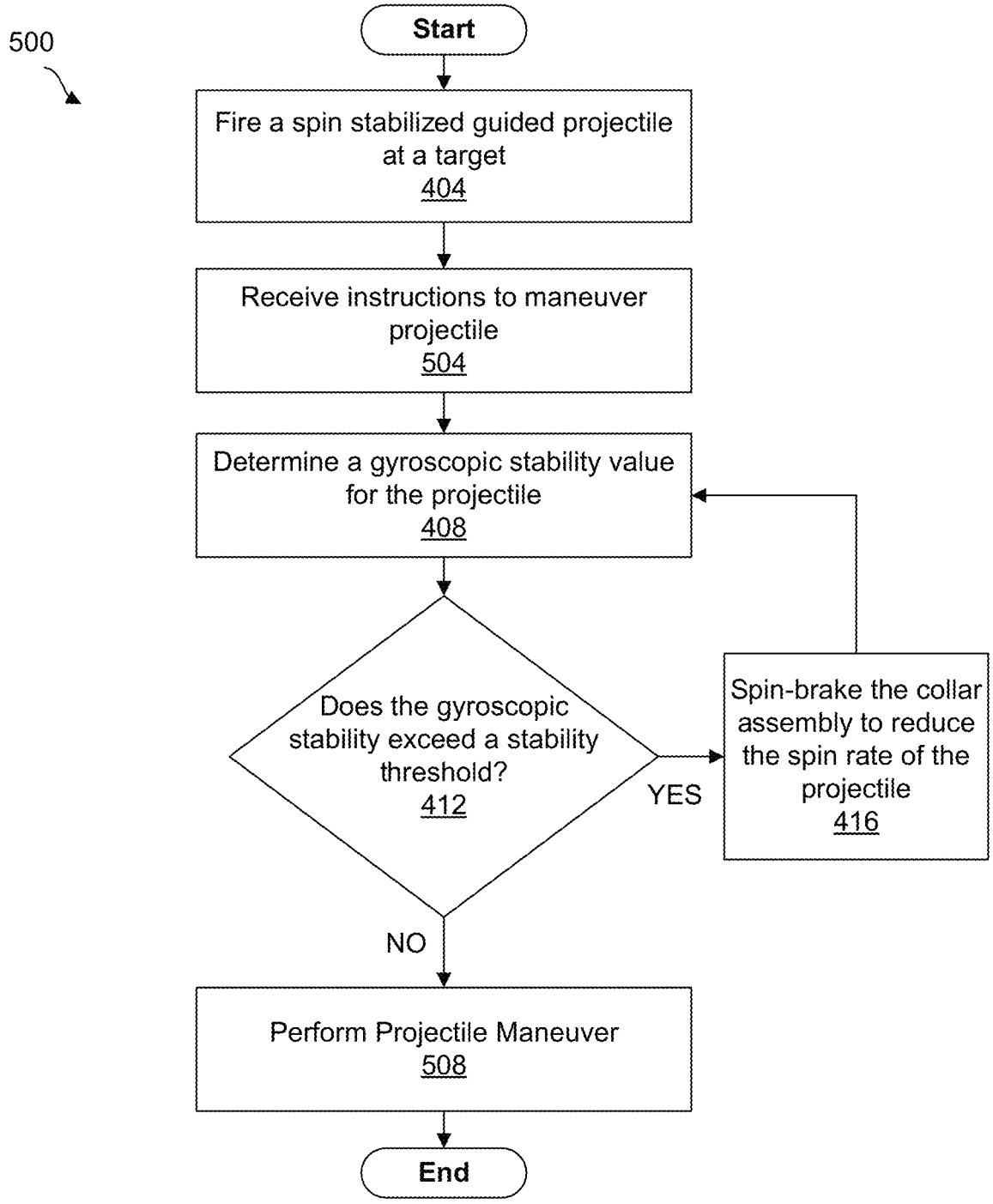
FIG. 5 depicts a flowchart diagram of a method of controlling an in-flight spin-rate of a spin-stabilized guided projectile is depicted according to one or more embodiments of the disclosure.

Referring to FIG. 5 a flowchart diagram of a method 500 of controlling an in-flight spin-rate of a spin-stabilized guided projectile is depicted according to one or more embodiments. In various embodiments method 500 is similar to method 400 of the FIG. 4, however, method 500 additionally includes operations 504 and 508. In one or more embodiments, the method 500 includes, at operation 504 receiving instructions to maneuver the projectile. In response, in one or more embodiments, the method 500 includes, at operation 408 determining the gyroscopic stability factor for the projectile. In various embodiments, if the projectile has a gyroscopic stability within the stability threshold, then the method 500 proceeds to operation 508 where the projectile performs the projectile maneuver. However, if the projectile has a gyroscopic stability value outside of or exceeding the stability threshold, the method proceeds to operation 516 where the method 500 spin brakes the collar and then continues to monitor and lower the gyroscopic stability value until it is below the stability threshold.

Once the gyroscopic stability does not exceed the stability threshold, then, in decision block 412 the method 500 then proceeds to operation 508 where the method 500 includes performing the projectile maneuver.

In this manner, in various embodiments, the method 500 limits the occurrence of spin-braking to when required to perform a projectile maneuver. As such, any flight inefficiencies caused as a result of or related to spin-braking are generally limited. As such, in various embodiments, the projectile can realize the performance improvements of embodiments of the disclosure while reducing any inefficiencies caused as a result of the spin-braking techniques.

Figure 6:
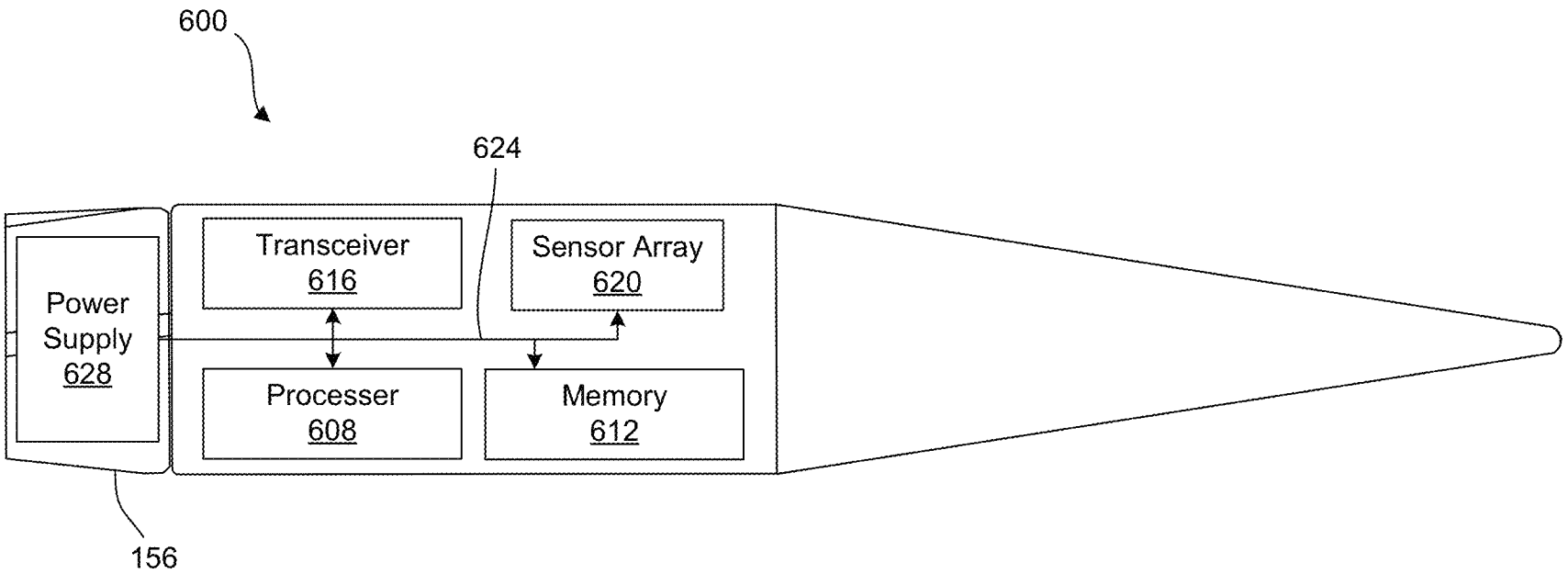
FIG. 6 depicts a system diagram of a guided projectile including a processor and memory, according to one or more embodiments.

Referring to FIG. 6, a system architecture for a guided projectile 600 is depicted, according to one or more embodiments. In various embodiments, guided projectile 600 is the same or substantially similar to guided projectile 100 described above and depicted with reference to at least FIGS. 1-2D. The guided projectile 600 may include a processor 608, memory 612, a transceiver 616, a sensor array 620, and a bus 624 that couple the various system components. In one or more embodiments, the various components in the guided projectile 600 represent a special purpose computing system for projectile flight control, sensor based target measurements, in-flight spin rate control, and for other functions, according to embodiments disclosed herein.

In one or more embodiments, the guided projectile 600 may include executable instructions, such as program modules, stored in memory 612 (e.g. computer readable storage medium) for execution by the processor 608. Program modules may include routines, programs, objects, instructions, logic, data structures, and so on, that perform particular tasks according to one or more of the embodiments described herein.

In one or more embodiments, the guided projectile 600 includes the sensor array 620 for determining projectile velocity, projectile spin rate, and other data for determining an SG for the projectile 600.

In various embodiments, guided projectile 600 includes a power source 628 in the form of an alternator that is configured to generate power for the projectile 600. For example, in one or more embodiments, when fired, a flight control portion in the form of a collar 156 is aerodynamically despun relative to the remainder of the projectile 600 causing relative rotation between elements of the alternator and thereby generating sufficient power for operation of the processor 608, memory 612, transceiver 616, and sensor array 620. In certain embodiments, power source 628 may additionally include a battery.

One or more embodiments may be a computer program product. The computer program product may include a computer readable storage medium (or media) including computer readable program instructions for causing a processor control an in-flight spin rate of a spin-stabilized projectile, according to the various embodiments described herein.

The computer readable storage medium is a tangible non-transitory device that can retain and store instructions for use by an instruction execution device. The computer readable storage medium may be, for example, an electronic storage device, a magnetic storage device, an optical storage device, or other suitable storage media.

A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Program instructions, as described herein, can be downloaded to respective computing/processing devices from a computer readable storage medium or to an external computer or external storage device via a network, for example, the Internet, a local area network, a wide area network and/or a wireless network. A network adapter card or network interface in each computing/processing device may receive computer readable program instructions from the network and forward the computer readable program instructions for storage in a computer readable storage medium within the respective computing/processing device.

Computer readable program instructions for carrying out one or more embodiments, as described herein, may be assembler instructions, instruction-set-architecture (ISA) instructions, machine instructions, machine dependent instructions, microcode, firmware instructions, state-setting data, or either source code or object code written in any combination of one or more programming languages, including an object oriented programming language such as Smalltalk, C++ or the like, and conventional procedural programming languages, such as the "C" programming language or similar programming languages.

The computer readable program instructions may execute entirely on a single computer, or partly on the single computer and partly on a remote computer. In some embodiments, the computer readable program instructions may execute entirely on the remote computer. In the latter scenario, the remote computer may be connected to the single computer through any type of network, including a local area network (LAN) or a wide area network (WAN), or public network.

One or more embodiments are described herein with reference to a flowchart illustrations and/or block diagrams of methods, systems, and computer program products for enhancing target intercept according to one or more of the embodiments described herein. It will be understood that each block of the flowchart illustrations and/or block diagrams, and combinations of blocks in the flowchart illustrations and/or block diagrams, may be implemented by computer readable program instructions.

These computer readable program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the functions/acts specified in the flowcharts and/or block diagram block or blocks.

The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowchart and/or block diagram block or blocks.

The flowchart and block diagrams in the Figures illustrate the architecture, functionality, and operation of possible implementations of systems, methods, and computer program products according to various embodiments of the present invention. In this regard, each block in the flowchart or block diagrams may represent a module, segment, or portion of instructions, which comprises one or more executable instructions for implementing the specified logical function(s). In some embodiments, the functions noted in the block may occur out of the order noted in the figures. For example, two blocks shown in succession may, in fact, be executed substantially concurrently, or the blocks may sometimes be executed in the reverse order, depending upon the functionality involved.

The descriptions of the various embodiments of the present disclosure have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to explain the principles of the embodiments, the practical application or technical improvement over technologies found in the marketplace, or to enable others of ordinary skill in the art to understand the embodiments disclosed herein.

In addition to the above, the disclosure of U.S. Pat. No. 6,981,672, which is owned by the owner of this application is incorporated by reference herein. Also incorporated by reference herein, U.S. Pat. Nos. 6,422,507; 7,412,930; 7,431,237; 6,345,785; 8,916,810; 6,653,972; 7,631833; 7,947,936; and 8,063,347.

The descriptions of the various embodiments of the present disclosure have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to explain the principles of the embodiments, the practical application or technical improvement over technologies found in the marketplace, or to enable others of ordinary skill in the art to understand the embodiments disclosed herein.

What is claimed is:

1. A method of controlling an in-flight spin-rate of a spin-stabilized guided projectile having a nose portion with a forward tip, a body portion, a tail portion, and a central axis, the projectile including a chassis extending from the tail portion to the nose portion, the chassis defining a generally cylindrical wall of the body portion and further defining a control support portion including a despun control portion configured for despinning relative to a projectile chassis and for directional control of the projectile, the projectile including one or more power generation components secured to one or more of the despun control portion and the control support portion for providing power generation and for braking of the despun control portion, the method comprising:

determining a gyroscopic stability factor for the guided projectile using the in-flight spin rate of the chassis and a forward velocity of the guided projectile;

determining that the gyroscopic stability factor exceeds a stability threshold; and spin-braking the chassis of the guided projectile, in response to determining that the gyroscopic stability factor exceeds a threshold value, by using the one or more power generation components to brake the rotation of the despun control portion, and by which the gyroscopic stability factor of the guided projectile is reduced to a second gyroscopic stability factor.

2. The method of claim 1, wherein spin-braking the chassis includes:

braking the rotation of the despun control portion at a braking magnitude in the range of 0 to 1.0;

determining that the second gyroscopic stability factor does not exceed the stability threshold; and ending the spin-braking of the despun control portion in response to determining that the second gyroscopic stability factor does not exceed the stability threshold.

3. The method of claim 1, wherein the stability threshold is a gyroscopic stability factor of 3.0 or higher.

4. The method of claim 1, wherein the stability threshold is a gyroscopic stability factor of 2.5 or higher.

5. The method of claim 1, wherein the stability threshold is a gyroscopic stability factor of 2.0 or higher.

6. The method of claim 1, wherein the guided projectile is fired from a projectile delivery system having an initial gyroscopic stability factor in the range of 1.3 to 1.7.

7. The method of claim 1, wherein the guided projectile is fired from a projectile delivery system having an initial spin rate of the chassis in the range of 1200 Hertz to 1400 Hertz.

8. The method of claim 1, wherein the guided projectile is fired from a projectile delivery system having an initial spin rate of the chassis in the range of 800 Hertz to 2000 Hertz.

9. The method of claim 1, wherein the projectile is fired from a projectile delivery system having an initial despun control portion spin rate in the range of 1200 Hertz to 1400 Hertz.

10. The method of claim 1, wherein the guided projectile is fired from a projectile delivery system having an initial despun control portion spin rate in the range of 800 Hertz to 2000 Hertz.

11. The method of claim 1, wherein the gyroscopic stability factor is quantified by the equation:

$$SG = \frac{2Lx^2 \cdot \left(\frac{p}{v}\right)^2}{\pi Ly \cdot \rho \cdot Cma \cdot d^3}$$

where Lx is the axial moment of inertia of a projectile, p is the spin rate of the projectile, v is the velocity of the projectile, Ly is the transverse moment of inertia of the projectile, ρ is the air density, Cma is the pitching moment coefficient derivative for the projectile, and d is the diameter of the projectile.

12. A spin-stabilized guided projectile having a nose portion with a forward tip, a body portion, a tail portion, and a central axis, the projectile comprising:

a chassis extending from the tail portion to the nose portion, the chassis defining a generally cylindrical wall of the body portion and further defining, at the tail portion, a control support portion;

a despun control portion rotatably mounted to the control support portion, the despun control portion having a circumferentially and axially extending exterior sidewall with a plurality of aerodynamic surfaces thereon for despinning the despun control portion relative to the chassis and for directional control of the projectile;

one or more power generation components secured to one or more of the despun control portion and the control support portion for providing power generation and for braking of the despun control portion;

a processor; and a computer readable storage medium, wherein the computer readable storage medium is not a transitory signal per se, the computer readable storage medium including a set of program instructions executable by the processor to cause the processor to:

determine a gyroscopic stability factor for the guided projectile using the in-flight spin rate of the chassis and a forward velocity of the guided projectile;

determine that the gyroscopic stability factor exceeds a stability threshold; and spin-brake the chassis of the guided projectile, in response to determining that the gyroscopic stability factor exceeds a threshold value, by using the one or more power generation components to brake the rotation of the despun control portion, and by which the gyroscopic stability factor of the guided projectile is reduced to a second gyroscopic stability factor.

13. The projectile of claim 12, wherein the set of program instructions executable by the processor to cause the processor to spin-brake the chassis includes causing the processor to:

brake the rotation of the despun control portion at a braking magnitude in the range of 0 to 1.0; determine that the second gyroscopic stability factor does not exceed the stability threshold; and end the spin-braking of the despun control portion in response to determining that the second gyroscopic stability factor does not exceed the stability threshold.

14. The projectile of claim 12, wherein the set of program instructions executable by the processor to cause the processor to spin-brake the chassis includes causing the processor to:

brake the rotation of the despun control portion at an initial braking magnitude of approximately 0.5;

increase, at a first rate, the initial braking magnitude to a second braking magnitude, the second braking magnitude in the range of 0.5 to 1.0;

determine that the second gyroscopic stability factor does not exceed the stability threshold; and end the spin-braking of the despun control portion in response to determining that the second gyroscopic stability factor does not exceed the stability threshold.

15. The projectile of claim 14, wherein the set of program instructions executable by the processor to cause the processor to end the spin-braking of the despun control portion includes causing the processor to:

decrease, at a second rate, the second braking magnitude to a third braking magnitude, the third braking magnitude in the range of 0.4 to 0.5; and decrease, at a third rate, the third braking magnitude to a fourth braking magnitude of zero.

16. The projectile of claim 12, wherein the stability threshold is a gyroscopic stability factor of 3.0 or higher.

17. The projectile of claim 12, wherein the guided projectile is fired from a projectile delivery system having an initial gyroscopic stability factor in the range of 1.3 to 1.7.

18. The projectile of claim 12, wherein all of the aerodynamic surfaces of the despun control portion are within an outermost axial envelope of the projectile.

* * * * *